US010509360B2

(12) United States Patent
Hijikata et al.

(10) Patent No.: US 10,509,360 B2
(45) Date of Patent: Dec. 17, 2019

(54) IMAGE FORMING APPARATUS WITH REMOVABLE CARTRIDGES MOUNTED ON TRAY

(71) Applicant: CANON KABUSHIKI KAISHA, Tokyo (JP)

(72) Inventors: Shunsuke Hijikata, Yokohama (JP); Yuichiro Inaba, Chigasaki (JP); Toshiyuki Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/976,370

(22) Filed: May 10, 2018

(65) Prior Publication Data

US 2018/0329363 A1 Nov. 15, 2018

(30) Foreign Application Priority Data

May 10, 2017 (JP) ..... 2017-093519

(51) Int. Cl.
*G03G 21/18* (2006.01)

(52) U.S. Cl.
CPC ..... *G03G 21/1817* (2013.01); *G03G 21/1842* (2013.01)

(58) Field of Classification Search
CPC ..... G03G 21/1817; G03G 21/1842
See application file for complete search history.

(56) References Cited

U.S. PATENT DOCUMENTS

| | | | | |
|---|---|---|---|---|
| 4,866,482 | A * | 9/1989 | Hirasawa | G03G 15/751 399/113 |
| 5,266,998 | A * | 11/1993 | Lee | G03G 21/1821 399/113 |
| 8,737,870 | B2 | 5/2014 | Mori | |
| 2006/0045564 | A1* | 3/2006 | Ahn | G03G 21/1619 399/110 |
| 2008/0159772 | A1* | 7/2008 | Koishi | G03G 21/1871 399/90 |
| 2011/0299873 | A1* | 12/2011 | Ushiozu | G03G 15/04054 399/90 |
| 2018/0101131 | A1* | 4/2018 | Hosoi | G03G 15/0258 |
| 2018/0150024 | A1 | 5/2018 | Takahashi et al. | |

FOREIGN PATENT DOCUMENTS

| | | |
|---|---|---|
| JP | 2010-271743 A | 12/2010 |
| JP | 2012-208362 A | 10/2012 |

* cited by examiner

*Primary Examiner* — Susan S Lee
(74) *Attorney, Agent, or Firm* — Venable LLP

(57) ABSTRACT

An image forming apparatus includes a main assembly and a cartridge including at least an image bearing member. The apparatus further includes a tray drawable from the main assembly, wherein the cartridge is mountable to and dismountable from the tray in one direction and an opposite direction, respectively; and a light emission unit provided in the tray and including a plurality of light emission elements arranged in an axial direction of the image bearing member to form a latent image on the image bearing member. The cartridge is capable of being inserted into the tray by moving it in the one direction, in response to which the light emission unit is moved in a direction crossing with the one direction to outside of a movement range of insertion of the cartridge.

11 Claims, 15 Drawing Sheets

IMAGE FORMING APPARATUS WITH REMOVABLE CARTRIDGES MOUNTED ON TRAY

FIELD OF THE INVENTION AND RELATED ART

The present invention relates to an image forming apparatus such as a copying machine, a printing machine, and the like.

Some image forming apparatuses are structured to employ a process cartridge which is removably installable in their main assembly. A process cartridge comprises a photosensitive drum and at least one means for processing the photosensitive drum. It comprises also a cartridge (casing) in which the photosensitive drum and means for processing the photosensitive drum are integrally disposed. The processing means are a charging means, a development roller, and a cleaning means.

The peripheral surface of the photosensitive drum is exposed by an exposing means to form an electrostatic latent image. There is disclosed an example of exposing means in Japanese Laid-open Patent Application No. 2012-208362. This exposing means is in the form of an LED unit, which is provided with multiple LEDs (light emitting diodes) aligned in such a direction that is parallel to the axial line of a photosensitive drum. These LEDs are controlled in the timing with which they are made to emit light to form an electrostatic latent image on the peripheral surface of the photosensitive drum. Employment of an exposing means (LED unit), such as the one disclosed in the Japanese Laid-open Patent Application No. 2012-208362, which is made up of small light emitting elements (LEDs), makes it possible to reduce an exposing apparatus in size. Further, there is disclosed in Japanese Laid-open Patent Application No. 2010-271743, an image forming apparatus structured so that its drum unit by which a cartridge is held can be pulled out of the main assembly of the image forming apparatus. Thus, this image forming apparatus is excellent in terms of usability in that the cartridge therein can be easily replaced.

An LED unit is smaller in the amount of light emission than a laser scanner, and also, its gradient index lens for focusing the light from the LED is shorter in the focal distance than the counterpart of a laser scanner. Thus, an LED unit has to be disposed closer to a photosensitive drum. In the case of the image forming apparatus disclosed in Japanese Laid-open Patent Application No. 2012-208362, its LED unit is mounted in a drawer (tray). Thus, it is unnecessary to make the LED unit retract, in order to pull the drawer (tray) out of the main assembly of the image forming apparatus. In the drawer, however, the LED unit is disposed close to the top side of the photosensitive drum. Therefore, in order to insert a cartridge into the drawer (tray), or pull a cartridge out of the drawer (tray), the cartridge has to be moved to a position in which it does not come into contact with the LED unit when the cartridge is inserted into, or pulled out of, the drawer (tray). This requirement is likely to reduce an image forming apparatus in usability.

In the case of the image forming apparatus disclosed in Japanese Laid-open Patent Application No. 2010-271743, its LED unit is attached to the main assembly of the image forming apparatus. Thus, the image forming apparatus is structured so that when the drum unit (tray) is pulled out of the main assembly, the LED unit is made to retract upward of the main assembly. In order to structure an image forming apparatus so that its LED unit is retracted as described above, the main assembly of the image forming apparatus is required to be increased in size. This requirement reduces the merit provided by the employment of the LED unit which can contribute to the size reduction of an image forming apparatus.

SUMMARY OF THE INVENTION

According to an aspect of the present invention, there is provided an image forming apparatus comprising a main assembly; a cartridge including at least an image bearing member; a tray drawable from said main assembly, wherein said cartridge is mountable to and dismountable from said tray in one direction and an opposite direction, respectively; and a light emission unit provided in said tray and including a plurality of light emission elements arranged in an axial direction of said image bearing member to form a latent image on said image bearing member, wherein said cartridge is capable of being inserted into said tray by moving it in the one direction, in response to which said light emission unit is moved in a direction crossing with the one direction to an outside of a movement range of insertion of said cartridge.

Further features of the present invention will become apparent from the following description of exemplary embodiments with reference to the attached drawings.

Figure 3:
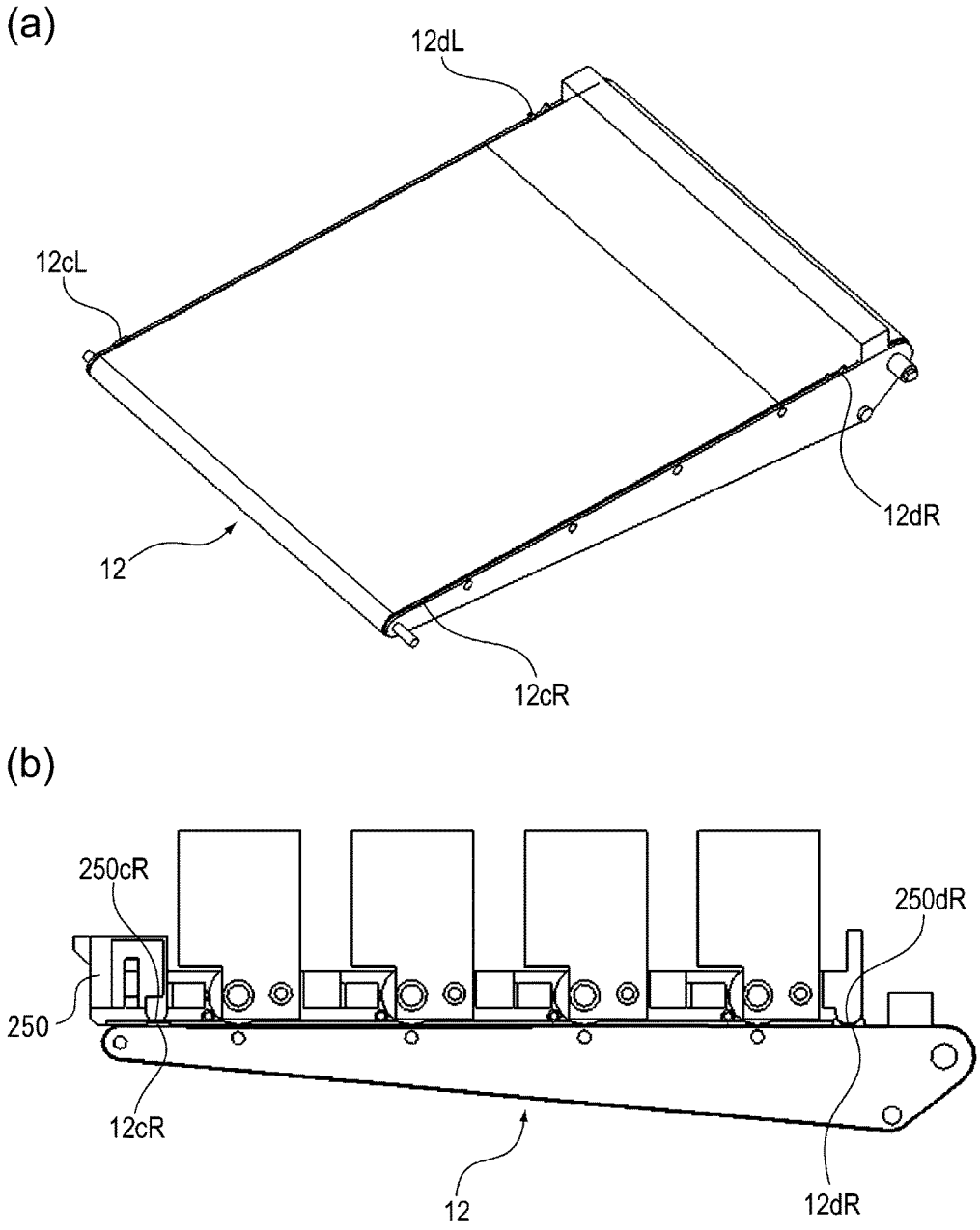

Part (a) of FIG. 3 is a perspective view of the intermediary transfer unit in the first embodiment, which is for describing the structure of the unit; and part (b) of FIG. 3 is a schematic sectional view of a combination of the intermediary transfer unit, tray, and process cartridges, at a vertical plane parallel to the moving direction of the transfer belt of the intermediary transfer unit, after the complete insertion of the tray into the main assembly of the image forming apparatus, in the first embodiment, which is for describing the structure of the combination.

Figure 4:
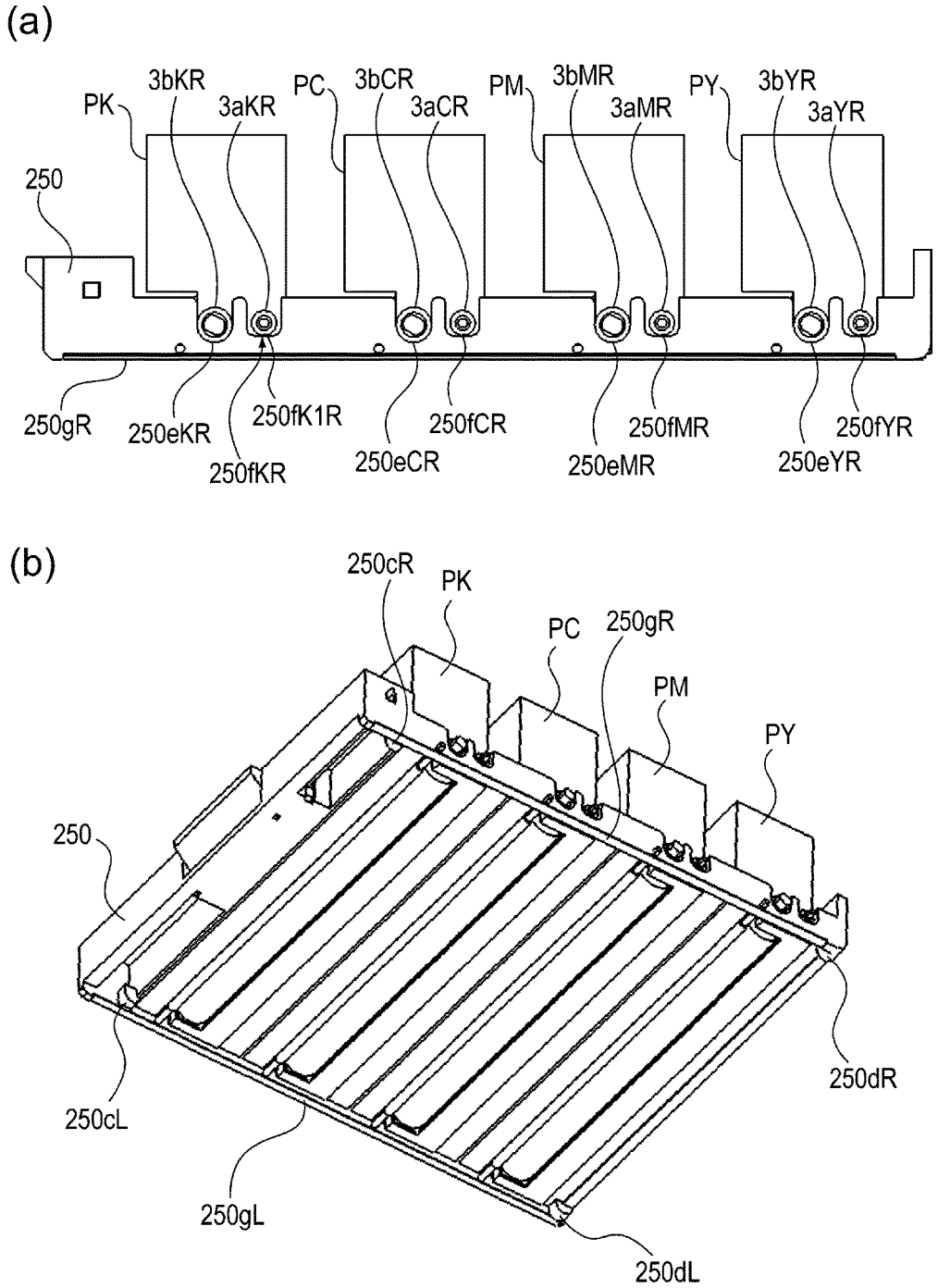

Part (a) of FIG. 4 is a sectional view of a combination of the tray and the cartridges in the first embodiment, at a vertical plane perpendicular to the direction which is parallel to the direction in which the tray is movable into, or out of, the main assembly of the apparatus, after the complete insertion of the cartridges into the tray; and part (b) of FIG. 4 is a perspective view of the combination of the tray and cartridge, after the complete insertion of the cartridges into the tray.

Figure 5:
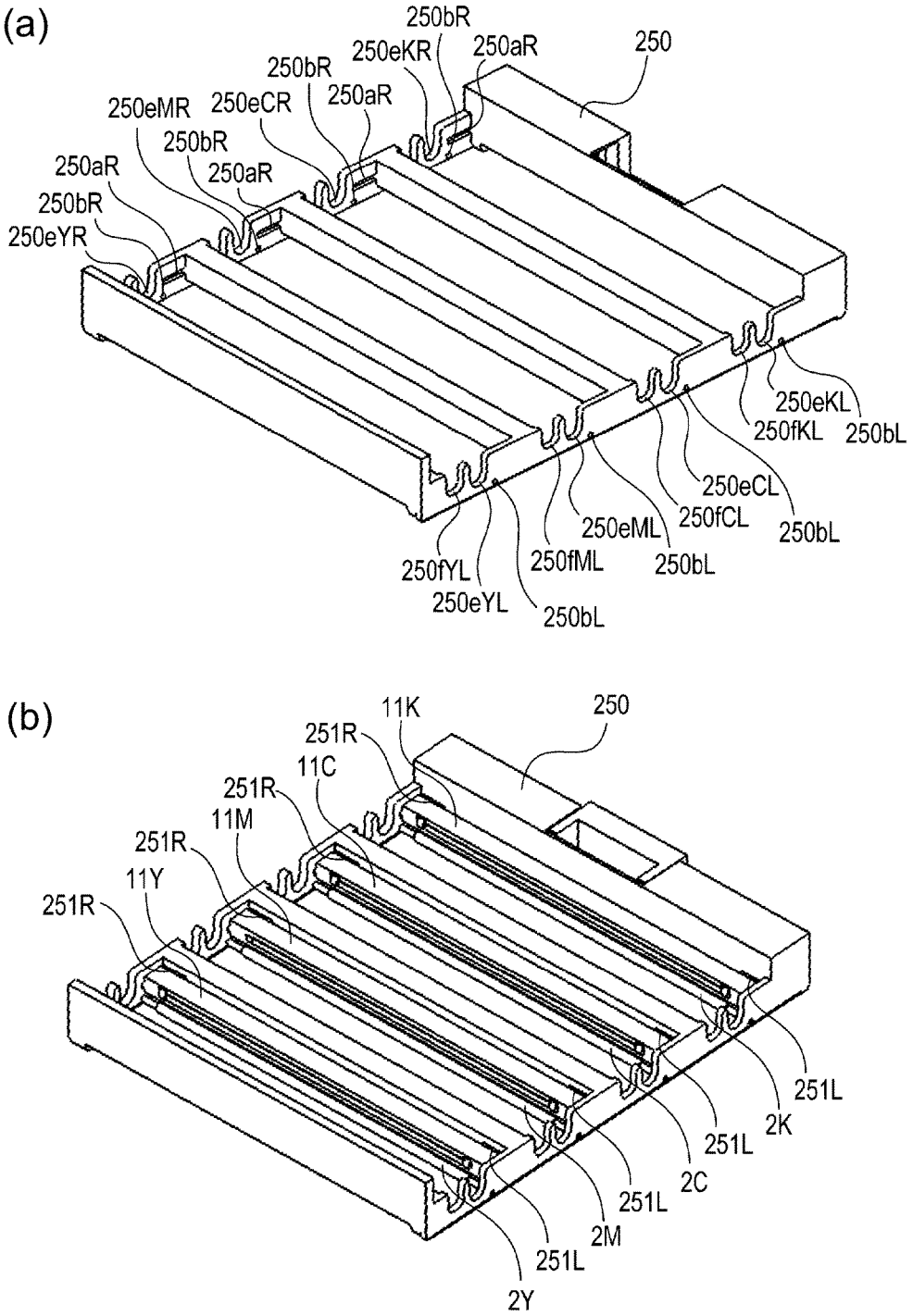

Part (a) of FIG. 5 is a perspective view of the tray in the first embodiment, which is for describing the structure of the tray; and part (b) of FIG. 5 is a perspective view of a combination of the tray, LED units, and charge rollers in the first embodiment, after the installation of the LED units and charge rollers into the tray, which is for describing the combination.

Figure 6:
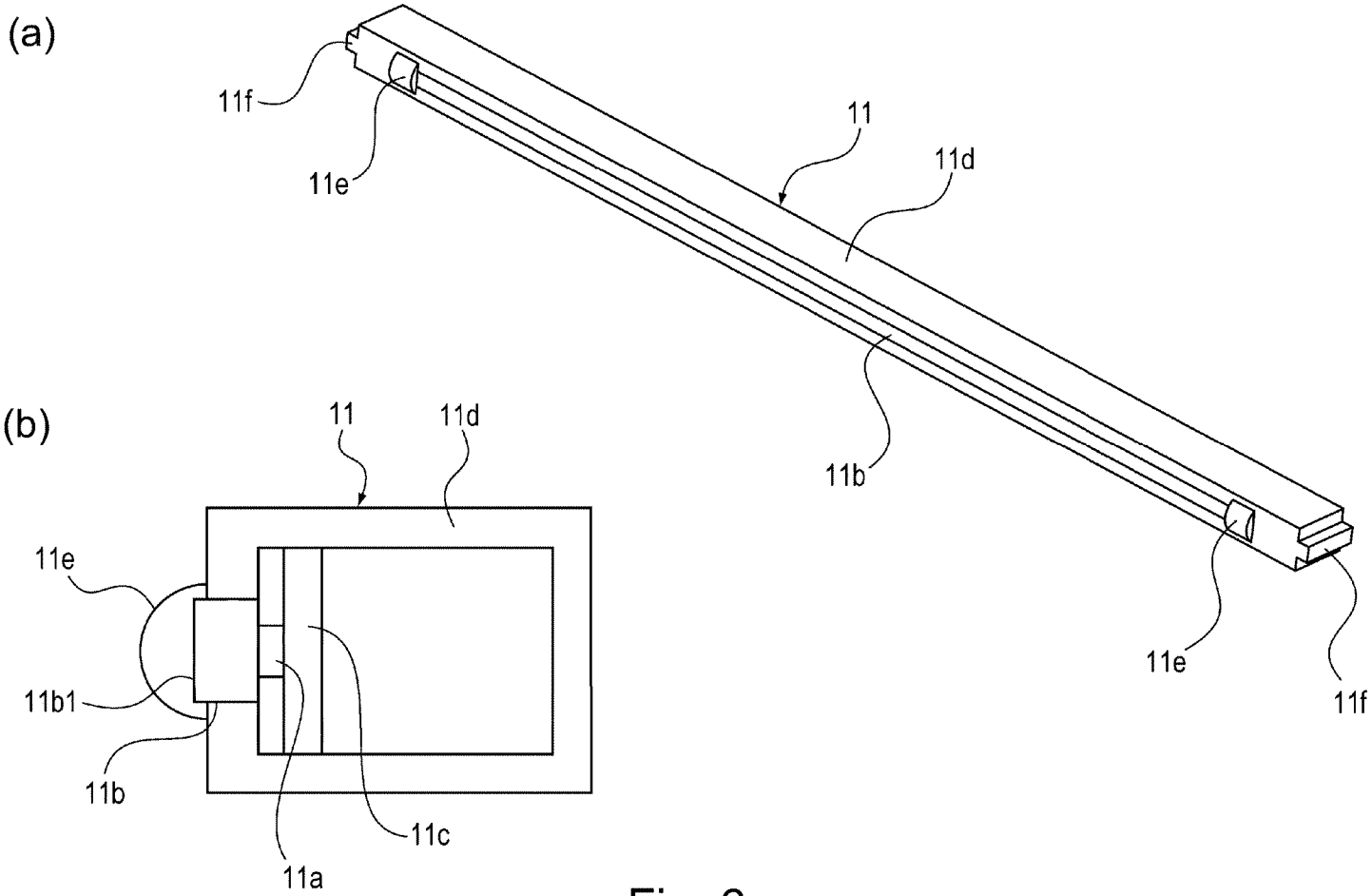

Part (a) of FIG. 6 is a perspective view of one of the LED units in the first embodiment, which shows the structure of the LED unit; and part (b) of FIG. 6 is a sectional view of the LED unit, which is for showing the structure of the LED unit.

Figure 7:
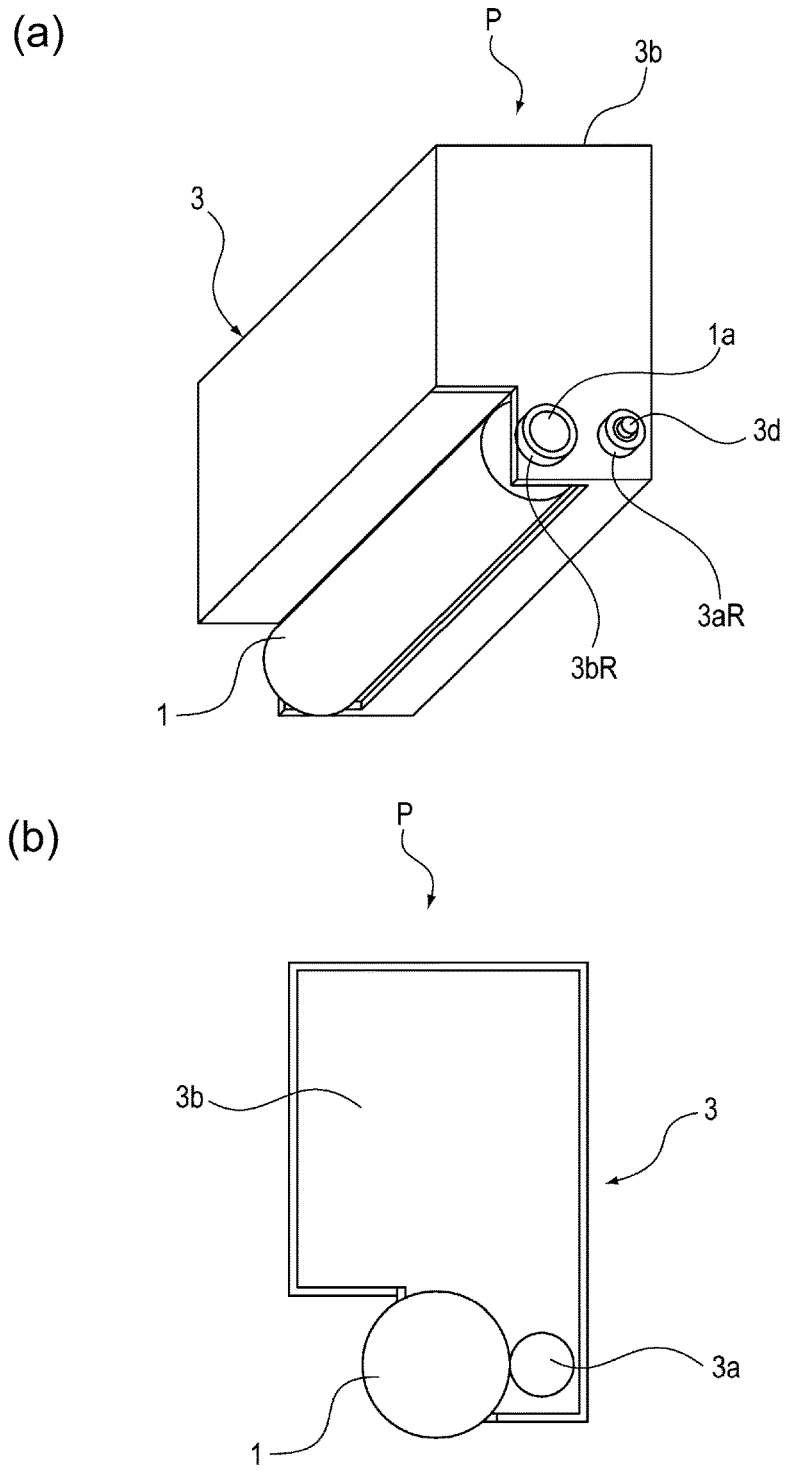

Part (a) of FIG. 7 is a perspective view of one of the cartridges in the first embodiment, which is for showing the structure of the cartridge; and part (b) of FIG. 7 is a sectional view of the cartridge, which is for showing the structure of the cartridge.

Figure 8:
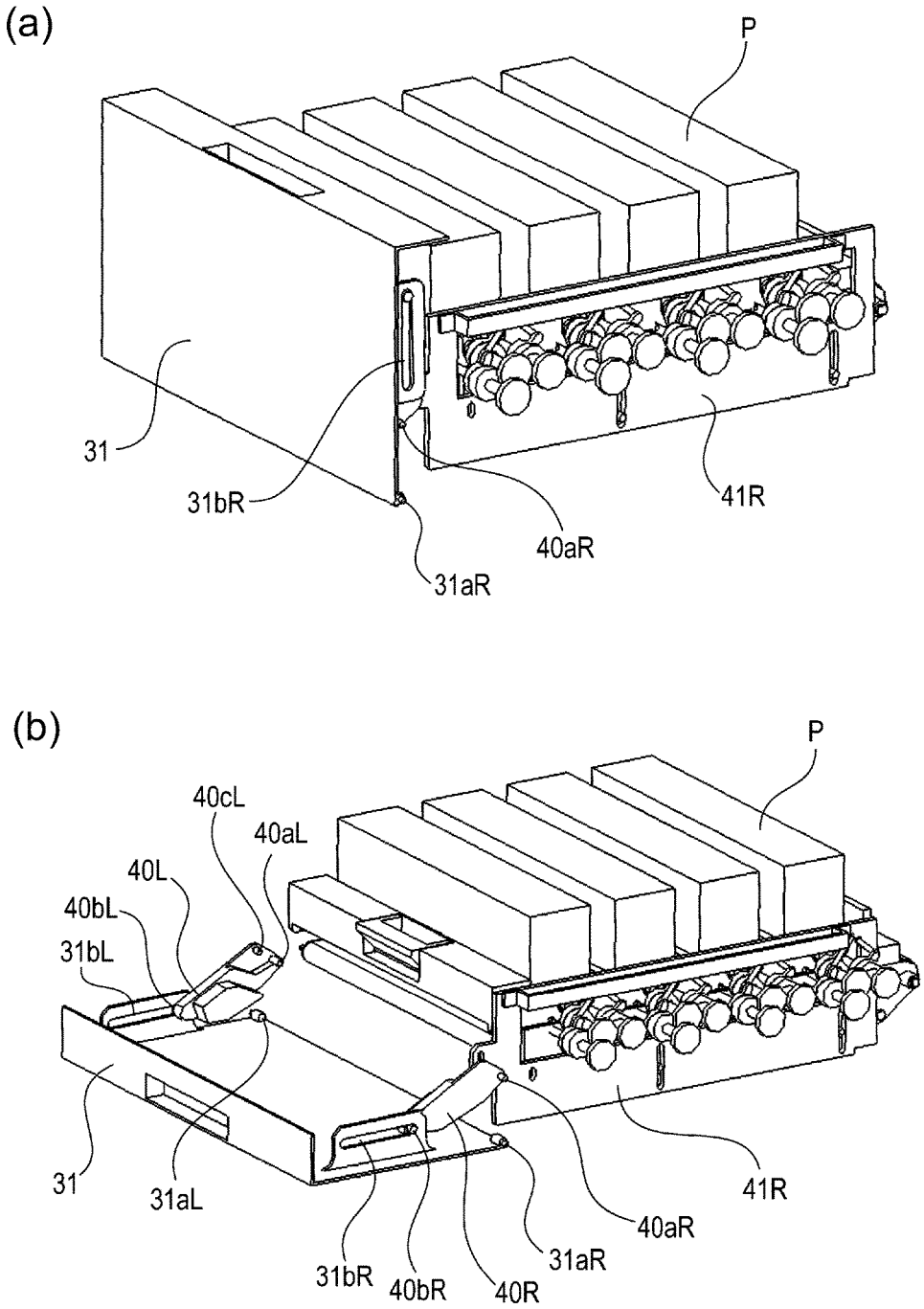

Part (a) of FIG. 8 is a perspective view of a combination of the tray, cartridges, and front door of the image forming apparatus in the first embodiment, when the front door is completely closed; and part (b) of FIG. 8 is a perspective view of the combination, when the front door is fully open.

Figure 9:
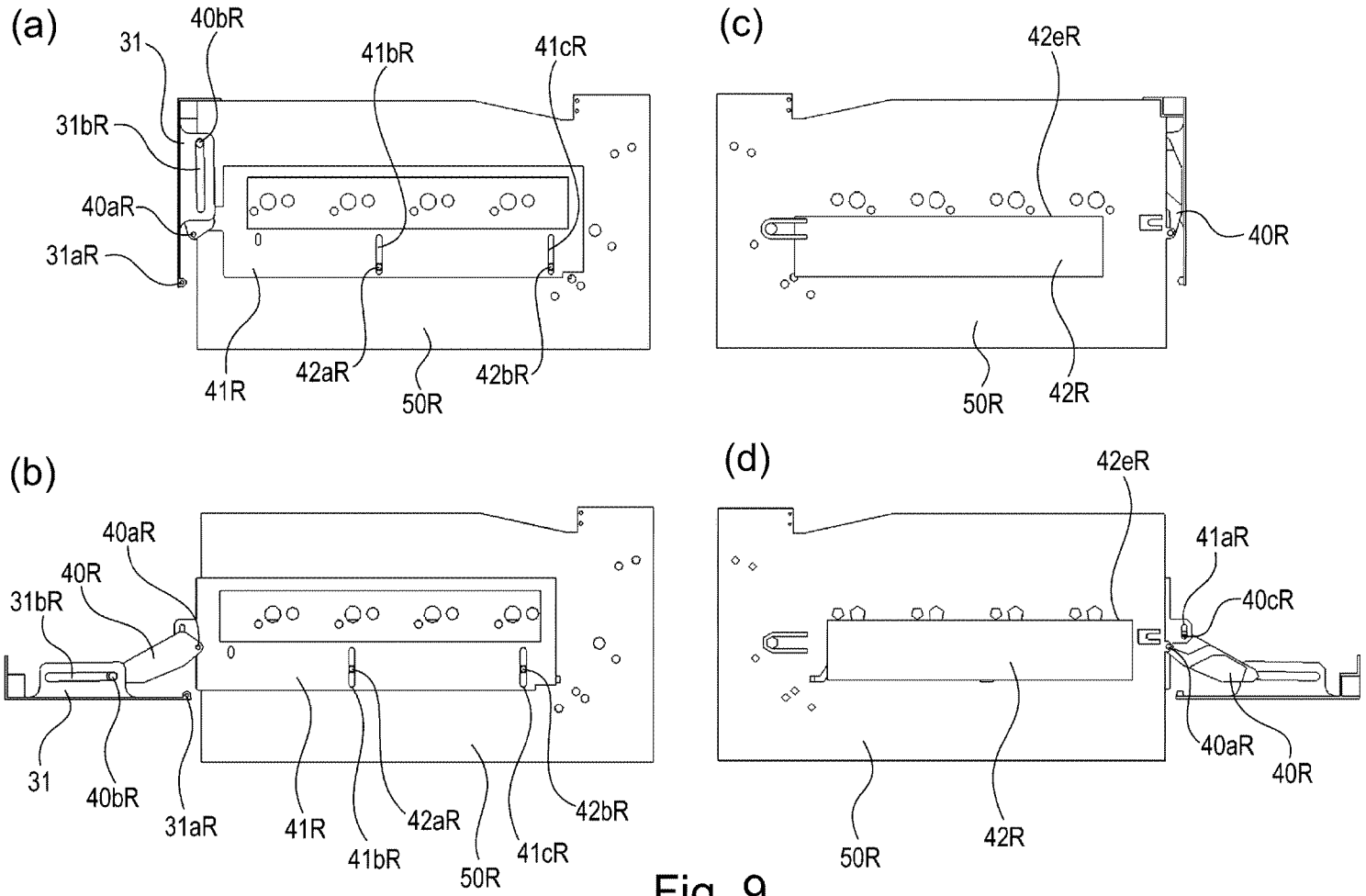

Part (a) of FIG. 9 is a phantom (see-through) side view of the image forming apparatus in the first embodiment when the front door of the apparatus is shut; part (b) of FIG. 9, a phantom side view of the image forming apparatus when the front door is fully open; part (c) of FIG. 9, a phantom side view of the image forming apparatus as seen from within the apparatus when the front door is completely shut; and part (d) of FIG. 9 is a perspective view of a combination of the tray, cartridges, and front door of the image forming apparatus in the first embodiment, as seen from within the apparatus when the front door is fully open.

Figure 10:
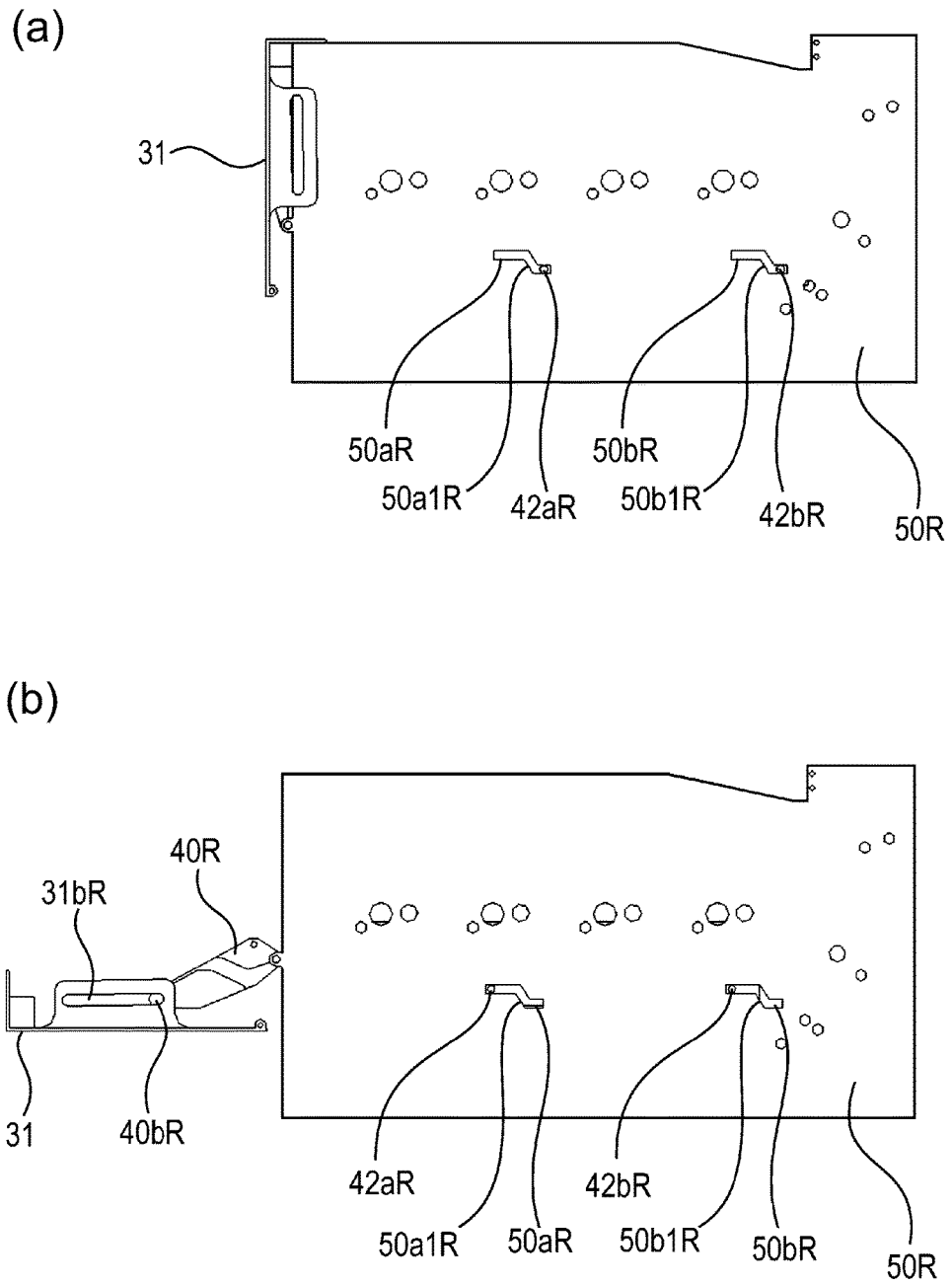

Part (a) of FIG. 10 is a side view of the image forming apparatus in the first embodiment when the front door of the apparatus is completely shut, which is for showing the position in which the slide cams are when the front door of the apparatus is completely shut; and part (b) of FIG. 10 is a side view of the image forming apparatus in the first embodiment when the front door of the apparatus is fully open, which is for showing the positions in which the slide cams are when the front door of the apparatus is fully open.

Figure 11:
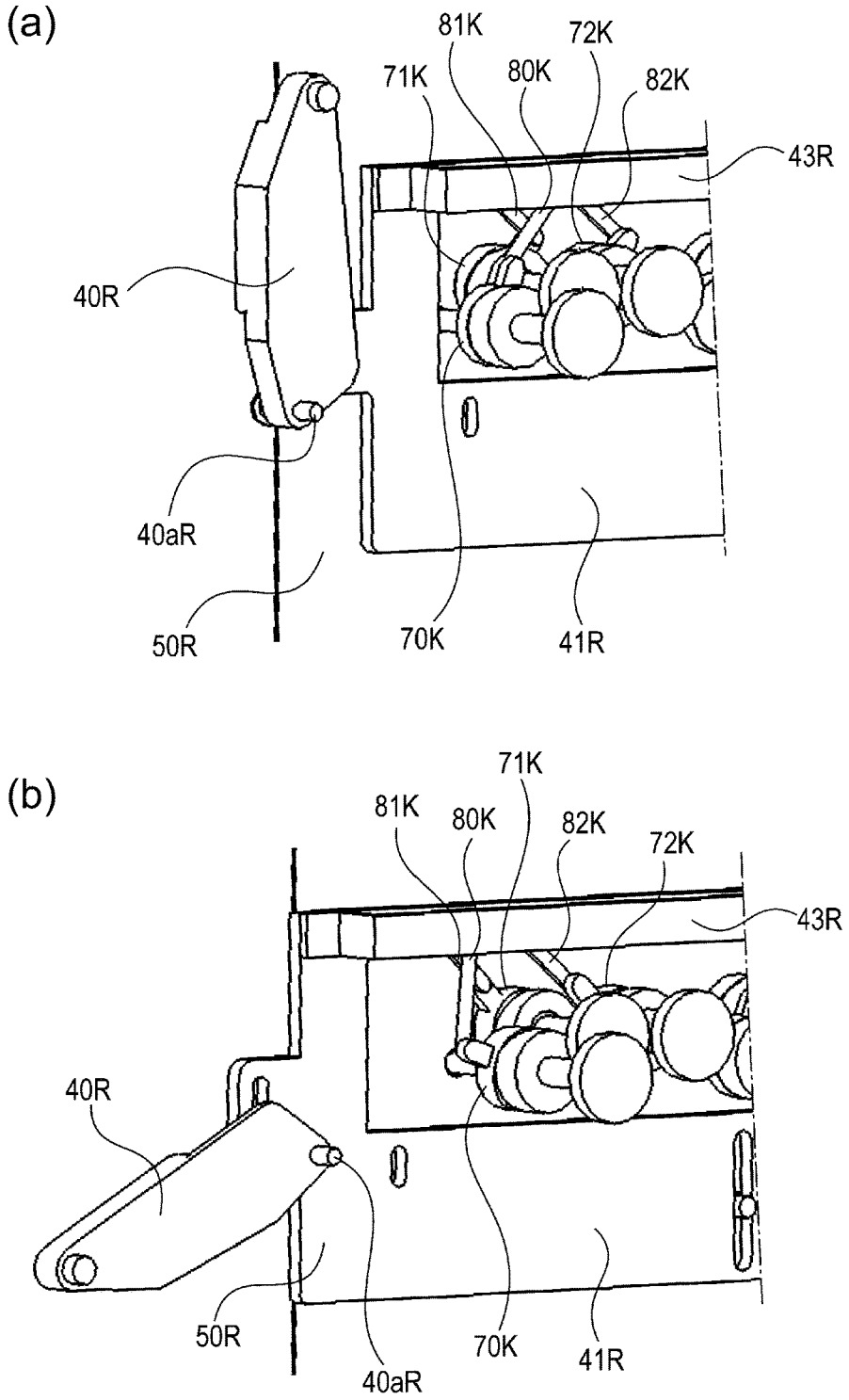

Part (a) of FIG. 11 is a perspective view of a combination of the driving system and linking member of the image forming apparatus in the first embodiment when the front door of the apparatus is completely closed, which is for showing the structure of the combination; and part (b) of FIG. 11 is a perspective view of the combination of the driving system and linking member of the image forming apparatus in the first embodiment when the front door of the apparatus is fully open, which is for showing the structure of the combination.

Figure 12:
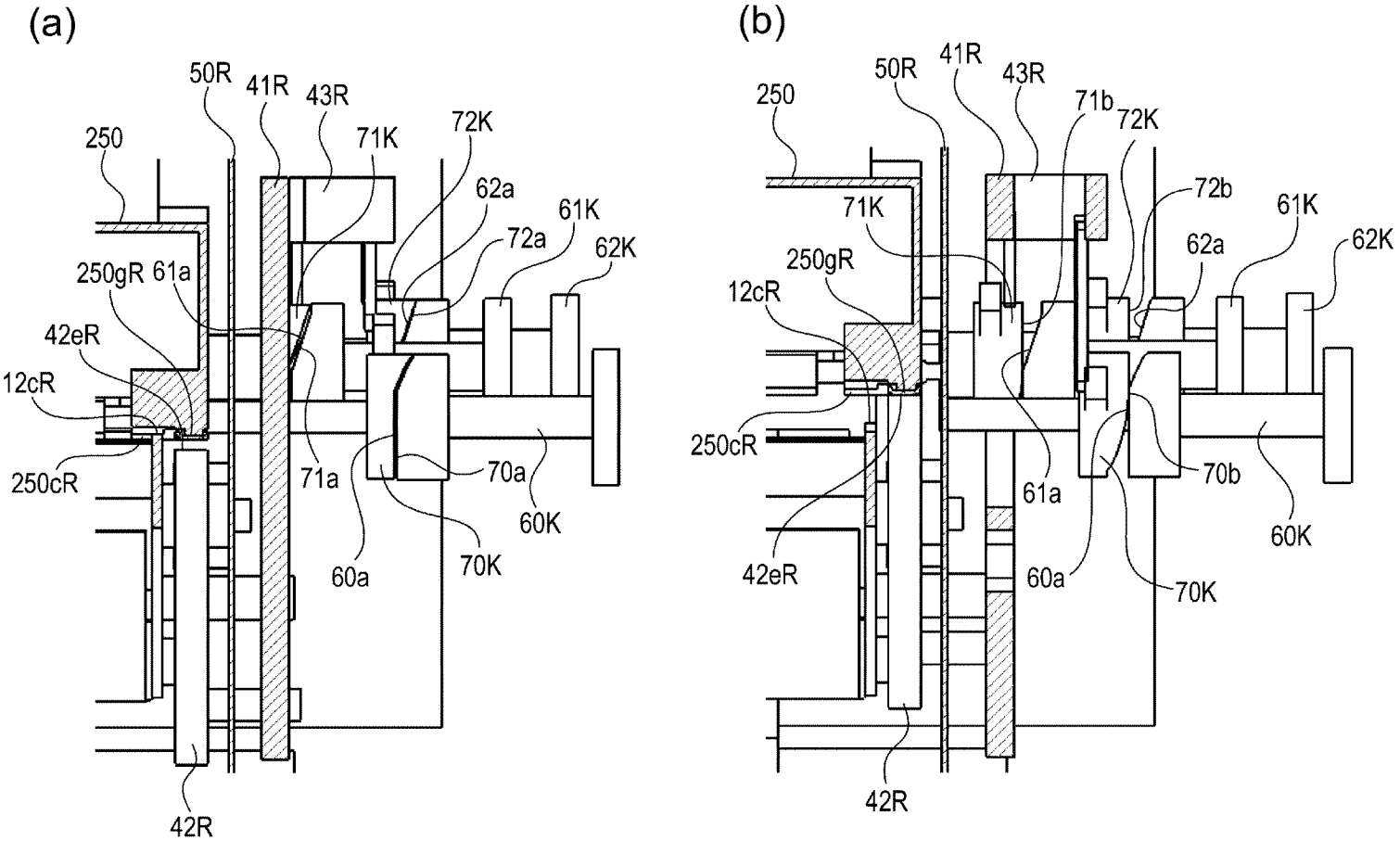

Part (a) of FIG. 12 is a side view of the drive train (system) of the image forming apparatus in the first embodiment when the charge roller, photosensitive drum, and development roller which are mounted in the tray, are in connection to the electrical power source through the drive train (system); and part (b) of FIG. 12 is a side view of the drive train (system) of the image forming apparatus in the first embodiment when the charge roller, photosensitive drum, and development roller which are mounted in the tray, are not in connection to the electrical power source through the drive train (system).

Figure 13:
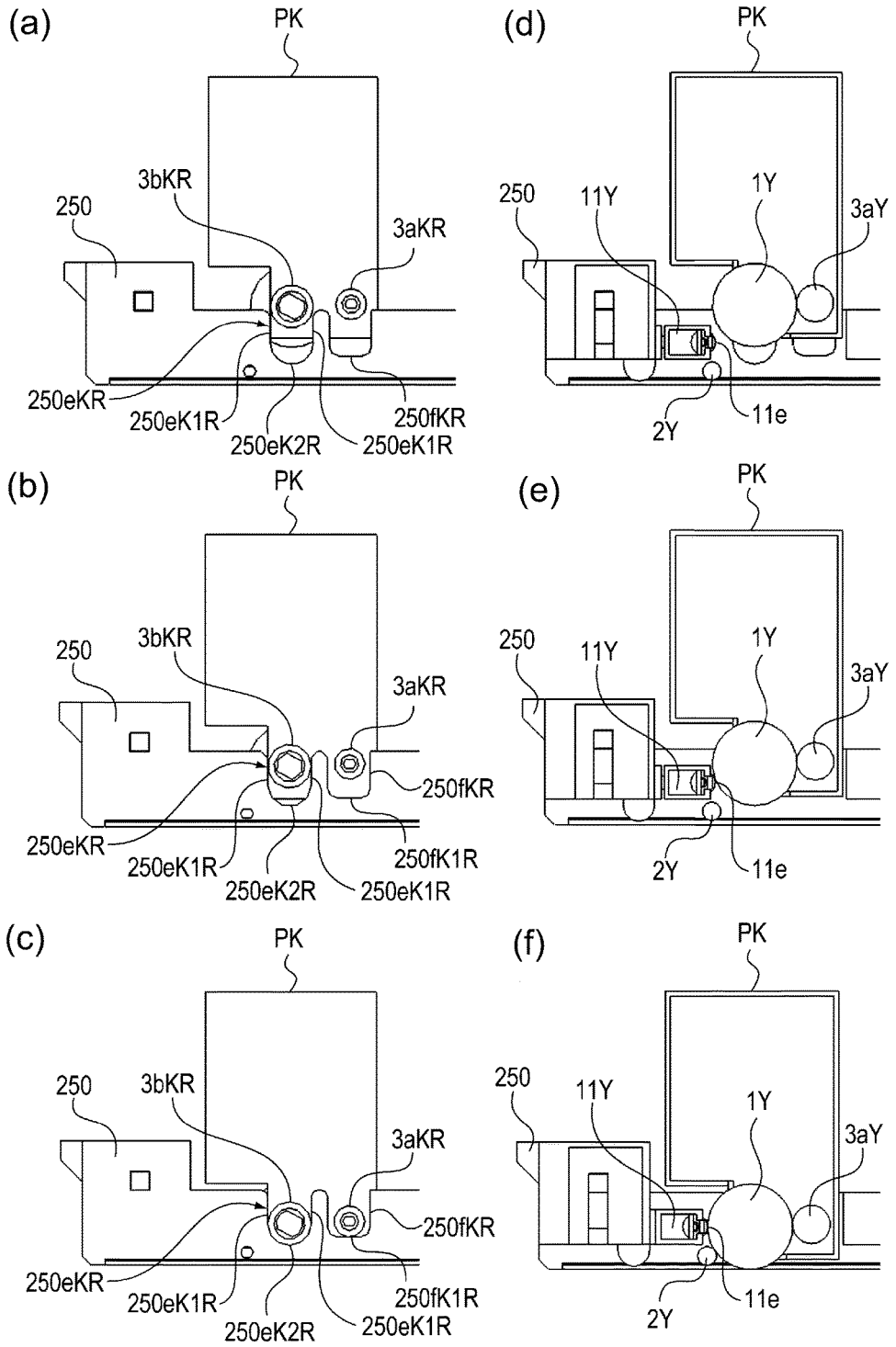

Part (a) of FIG. 13 is a side view of a combination of one of the cartridges, and the tray, as seen from the side from which the cartridge is driven, when the cartridge is about to be inserted into the tray; part (b) of FIG. 13, during the insertion of the cartridge into the tray; part (c) of FIG. 13, after the insertion; part (d) of FIG. 13, a side view of a combination of one of the cartridges, and the tray, as seen from the opposite side from the side from which the cartridge is driven, when the cartridge is about to be inserted into the tray; part (e) of FIG. 13, during the insertion of the cartridge into the tray; part (f) of FIG. 13 is a side view of the combination of one of the cartridges, and the tray, as seen from the opposite side from the side from which the cartridge is driven, after the insertion.

Figure 14:
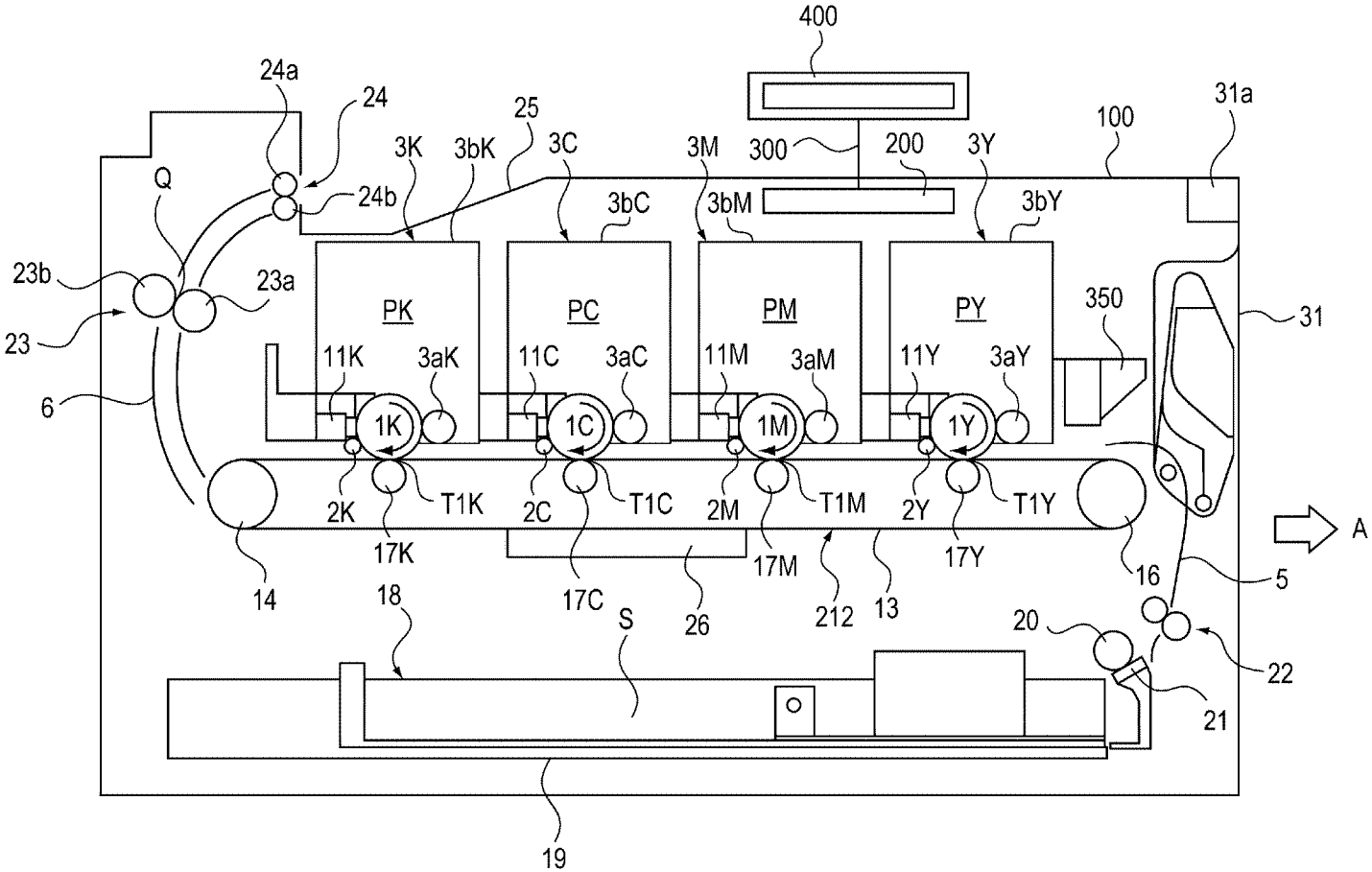

FIG. 14 is a sectional view of the image forming apparatus in the second embodiment of the present invention, which is for showing the structure of the apparatus.

Figure 15:
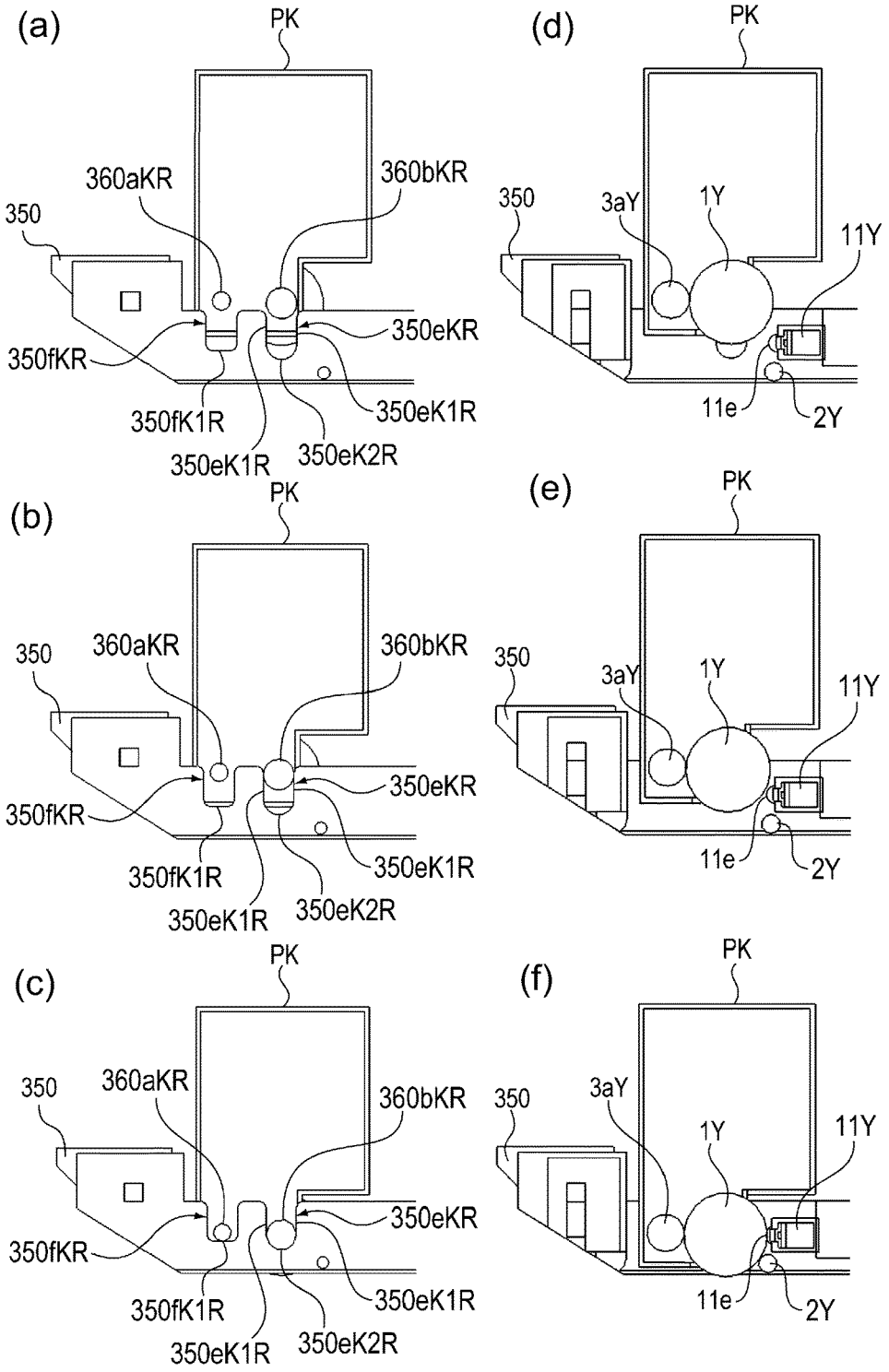

Part (a) of FIG. 15 is a side view of a combination of one of the cartridges, and the tray of the image forming apparatus in the second embodiment, as seen from the side from which the cartridge is driven, when the cartridge is about to be inserted into the tray; part (b) of FIG. 15, during the insertion of the cartridge into the tray; part (c) of FIG. 15, after the insertion; part (d) of FIG. 15, a side view of a combination of one of the cartridges, and the tray, as seen from the opposite side from the side from which the cartridge is driven, when the cartridge is about to be inserted into the tray; part (e) of FIG. 15, during the insertion of the cartridge into the tray; part (f) of FIG. 15 is a side view of the combination of one of the cartridges, and the tray after the insertion, as seen from the opposite side from the side from which the cartridge is driven.

DESCRIPTION OF THE EMBODIMENTS

Hereinafter, the present invention is concretely described with reference to the image forming apparatuses in a couple of preferred embodiments of the present invention.

Embodiment 1

To begin with, referring to FIGS. 1-13, the image forming apparatus 100 in the first embodiment of the present invention is described regarding its structure.

<Image Forming Apparatus>

Figure 1:
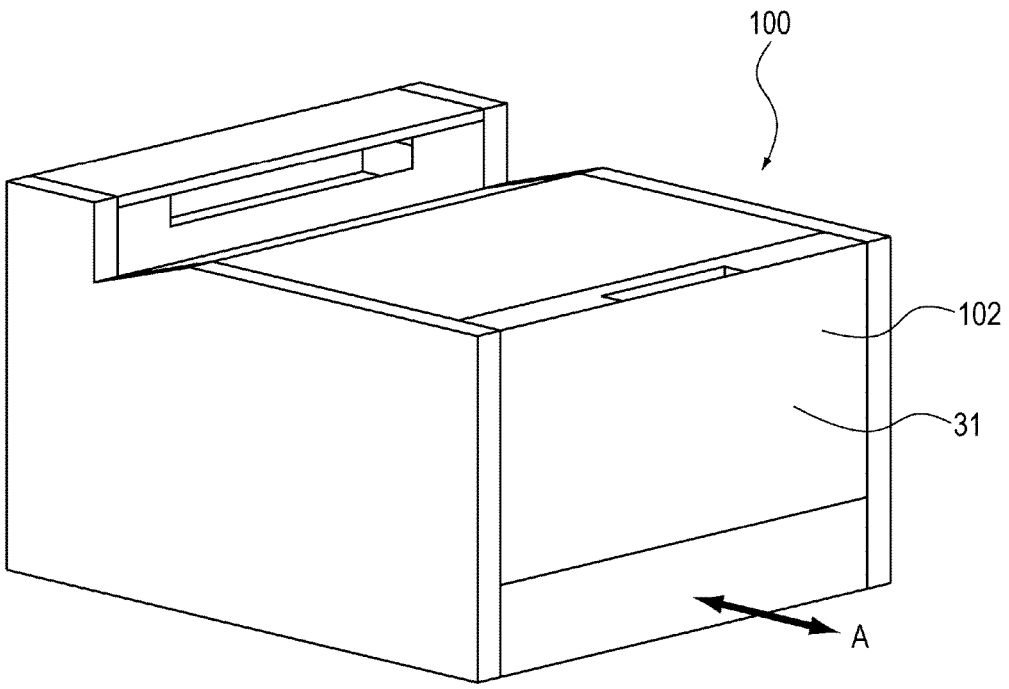
FIG. 1 is a perspective view of the image forming apparatus in the first embodiment of the present invention; it is for describing the structure of the apparatus.
Figure 2:
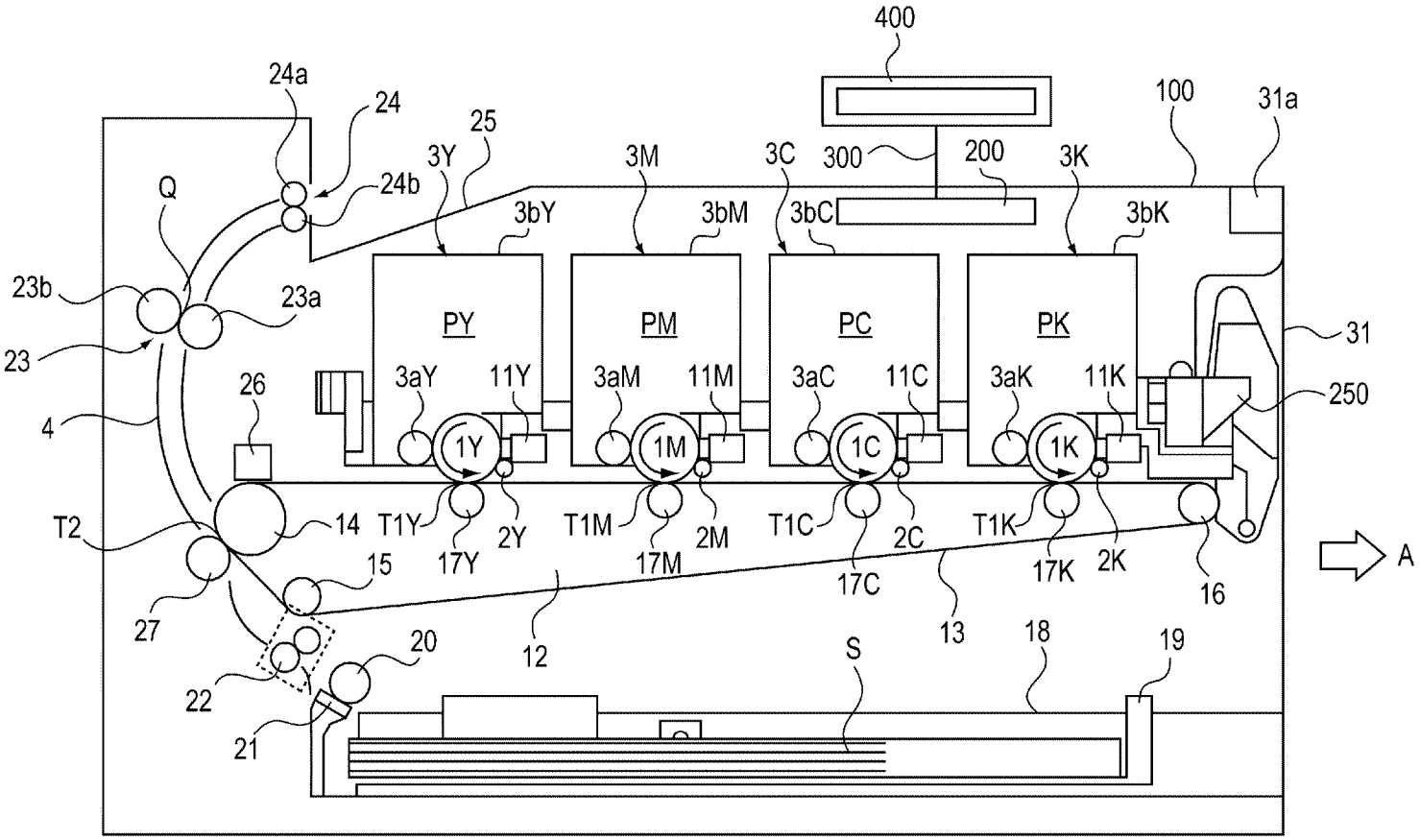
FIG. 2 is a sectional view of the image forming apparatus in the first embodiment; it is for describing the structure of the apparatus.

Referring to FIGS. 1 and 2, the image forming apparatus 100 in the first embodiment of the present invention is described regarding its structure. FIG. 1 is a perspective view of the image forming apparatus 100 in this embodiment. It is for describing the structure of the apparatus 100. FIG. 2 is a sectional view of the image forming apparatus 100 in the first embodiment. It is for describing the structure of the apparatus 100.

The image forming apparatus 100 shown in FIGS. 1 and 2 employs multiple cartridges, more specifically, four cartridges PY, PM, PC and PK, which are different in the color of the image they form. Each cartridge has at least a photosensitive drum 1, which is an image bearing member. The image forming apparatus 100 is a full-color printer. It uses an electrophotographic image formation process which employs LEDs (light emitting diodes).

By the way, for convenience sake, the cartridges PY, PM, PC and PK may be described as a cartridge P. Other image formation processing means may also be referred to without a suffix (Y, M, C and K). Each cartridge P is structured as a means for forming an image on a sheet S of recording medium.

The image forming apparatus 100 is enabled to form a full-color image (based on four primary colors), or a monochromatic image, on a sheet S of recording medium, based on electrical image formation signals, which are outputted from an external host apparatus 400 and inputted into the control portion 200 (as controlling means) of the image forming apparatus 100, through an interface portion 300. The external host apparatus 400 is a personal computer, an image reader, or a facsimile apparatus, for example, from which the signals are sent.

The control portion 200 is a means for controlling the image formation process of the image forming apparatus 100. It exchanges various electrical information with the external host apparatus 400. Further, it controls: the sequences for processing the electrical information inputted from various processing devices and sensors; sequence for processing command signals sent to the various processing devices; a preset initialization sequence; a preset image formation sequence; etc.

Referring to FIG. 1, the side 102 of the image forming apparatus 100, which is on the right-hand side of FIG. 1, is the front side of the image forming apparatus 100. The rear side of the image forming apparatus 100 is on the opposite side (left side of FIG. 1) of FIG. 1. Hereafter, the "front-rear direction" of the image forming apparatus 100 includes not only the "front-to-rear direction (left-to-right direction of FIG. 1)", but also, the opposite direction, or the "rear-to-front direction".

The left side and right side of the image forming apparatus 100 are the left side and right side of the image forming apparatus 100 as the apparatus 100 is seen from the front side (right side of FIG. 1) of the apparatus 100. Further, the leftward and rightward directions of the image forming apparatus 100 are the leftward direction, and the opposite direction (rightward direction) of the apparatus 100, respectively, as the apparatus 100 is seen from the front side (right side in FIG. 1).

<Light Emitting Unit>

The top and bottom sides of the image forming apparatus 100 are the top and bottom sides of the apparatus 100 with reference to the gravity direction. The upward direction is the bottom-to-top direction, and the downward direction is the top-to-bottom direction, respectively. Further, the lengthwise direction (of the image forming apparatus 100) is such a direction that is parallel to the axial line of the photosensitive drum 1 as an image bearing member. The widthwise direction is such a direction that is perpendicular to the lengthwise direction. Further, the driving side corresponds to one of the lengthwise ends of the photosensitive drum 1, whereas the non-driving side corresponds to the other lengthwise end of the photosensitive drum 1.

Referring to parts (a) and (b) of FIG. 8, in this embodiment, the right-hand side of the cartridge P in terms of the lengthwise direction is the driving side, and the left-hand side is the non-driving side. Referring to FIG. 2, the main assembly of the image forming apparatus 100 can accommodate four cartridges PY, PM, PC and PK. The four cartridges P are held by a tray 250, being aligned in the front-to-rear direction, in such a manner that they can be inserted into, or extracted from, the tray in only one direction (vertical direction). The image forming apparatus 100 is structured so that the tray 250 can be pulled out of the main assembly of the image forming apparatus 100 only in the direction indicated by an arrow mark A in FIG. 1. The tray 250 is structured to hold each cartridge P in such a manner that it is in only one direction (vertical direction) that each cartridge P can be inserted into, or extracted from, the tray 250.

A position in the tray 250, into which each cartridge P can be removably inserted, is such a position that enables the cartridge P to contribute to an image forming operation when the tray 250 is in the main assembly of the image forming apparatus 100. Each cartridge P contributes to the image formation process for forming an image on a sheet S of recording medium. It is used for image formation by being removably installed into the main assembly of the image forming apparatus 100. In this embodiment, each cartridge P has the photosensitive drum 1, as an image bearing member which is a photosensitive member in the form of a drum, and on which an electrostatic latent image is formable.

Each process cartridge P is provided with an image forming processing means which acts on the peripheral surface of the photosensitive drum 1. Referring to parts (a) and (b) of FIG. 7, in this embodiment, each cartridge P is structured as a process cartridge which has a development unit 3, as a developing means, which is an integral part of the cartridge P.

Referring to part (b) of FIG. 5, the tray 250 is provided with a charge roller 2 as a charging means for uniformly charging the peripheral surface of the photosensitive drum 1. It is also provided with an LED (light emitting diode) unit 11, as a light emitting unit, which is an exposing means for projecting a beam of light upon the uniformly charged portion of the peripheral surface of the photosensitive drum 1 while modulating the beam according to the information of the image to be formed.

To the charge roller 2, charge bias is applied from an unshown charge bias power source, so that a part of the peripheral surface of the photosensitive drum 1 is uniformly charged by the charge roller 2. The uniformly charged portion of the peripheral surface of the photosensitive drum 1 is exposed to the beam of light emitted from the LED unit 11 while being modulated according to the information of the image to be formed. Consequently, an electrostatic latent image is effected on the peripheral surface of the photosensitive drum 1.

The development unit 3 develops an electrostatic latent image formed on the peripheral surface of the photosensitive drum 1, into a toner image (developer image) by supplying the latent image with toner (developer). Each development unit 3 is provided with a developer storing portion 3*b*, in which toner (developer) is stored, and also, in which a development roller 3*a*, as a developer bearing member, is provided.

Each developer storing portion 3*b* is different from the other in the color of the toner (developer) stored therein. In the developer storing portion 3*b*Y of the development unit 3Y of the cartridge PY, yellow toner is stored to form a yellow toner image on the peripheral surface of the photosensitive drum 1Y.

In the developer storing portion 3*b*M of the development unit 3M of the cartridge PM, magenta toner is stored to form a magenta toner image on the peripheral surface of the photosensitive drum 1M. In the developer storing portion 3*b*C of the development unit 3C of the cartridge PC, cyan toner is stored to form a cyan toner image on the peripheral surface of the photosensitive drum 1C. In the developer storing portion 3*b*K of the development unit 3K of the cartridge PK, black toner is stored to form a black toner image on the peripheral surface of the photosensitive drum 1K.

The tray 250 is provided with four LED units 11. Each LED unit 11 is disposed so that after the insertion of the cartridge P into the tray 250, it is on the front side (right side in FIG. 2) of the corresponding photosensitive drum 1, being in the adjacencies of the peripheral surface of the photosensitive drum 1. Each LED unit 11 exposes the peripheral surface of the photosensitive drum 1 of the corresponding cartridge P; it scans the peripheral surface of the photosensitive drum 1 with the beam of light it emits while modulating the beam according to the information of the image to be formed. As a result, an electrostatic latent image is effected on the peripheral surface of the photosensitive drum 1.

Referring to FIG. 2, the image forming apparatus 100 is provided with an intermediary transfer unit 12, which is disposed so that when the four cartridges P are in the main assembly of the image forming apparatus 100, the intermediary transfer unit 12 is on the bottom side of each cartridge P. The intermediary transfer unit 13 has an intermediary transferring belt 13, as an intermediary transferring member, which is a flexible and endless belt formed of a dielectric substance. The intermediary transfer belt 13 is suspended and tensioned by a driver roller 14, an auxiliary roller 15, and a tension roller 16 in such a manner that it can be rotationally moved in the clockwise direction of FIG. 2. The driver roller 14 and auxiliary roller 16 are on the rear side (left side in FIG. 2) in the main assembly of the image forming apparatus 100. The tension roller 16 is on the front side (right side in FIG. 2) in the main assembly of the image forming apparatus 100.

The image forming apparatus 100 is structured so that after the insertion of each cartridge P into its preset image formation position in the tray 250, and the insertion of the tray 250 into the preset image formation position in the main assembly of the image forming apparatus 100, each photosensitive drum 1 is in its preset image formation position in the main assembly of the image forming apparatus 100, and the outward surface of the intermediary transfer belt 13, which is the intermediary transferring member, is in contact with the peripheral surface of the photosensitive drum 1 of each cartridge P.

The image forming apparatus 100 is provided with four primary transfer rollers 17, which are the primary transferring means. The primary transfer rollers 17 are disposed on the inward side of the loop (belt loop) which the intermediary transfer belt 13 forms, in such a manner that each primary transfer roller 17 is pressed against the peripheral surface of the corresponding photosensitive drum 1 with the presence of the intermediary transfer belt 13 between itself and photosensitive drum 1. To each primary transfer roller 17, primary transfer bias is applied from an unshown primary transfer bias power source. Thus, the toner image formed on the peripheral surface of each photosensitive drum 1 is transferred (primary transfer) onto the outward surface of the intermediary transfer belt 13, in such a manner that the four toner images are layered as the intermediary transfer belt 13 rotates in the clockwise direction in FIG. 2.

The nip formed between the peripheral surface of the photosensitive drum 1 in each cartridge P and the outward surface of the intermediary transfer belt 13 is the primary transfer nip T1. Further, the image forming apparatus 100 is provided with the secondary transfer roller 27, as the secondary transferring means, which is pressed against the driver roller 14 with the presence of the intermediary transfer belt 13 between itself and the driver roller 14. The nip formed by the secondary transfer roller 27 and the outward surface of the intermediary transfer belt 13 is the secondary transfer nip T2.

Provided below the intermediary transfer unit 12 is a sheet-feeding-conveying unit 18, which can store multiple sheets S of recording medium and conveys each sheet S to the secondary transfer nip T2. The sheet-feeding-conveying unit 18 has: a tray 19 in which multiple sheets S of recording medium are stored in layers; a separation pad 21; a feeding-conveying roller 20 which feeds the sheets S one by one into the main assembly of the image forming apparatus 100 in coordination with the separation pad 21; and a pair of registration rollers 22.

If a sheet S of recording medium happens to be conveyed askew by the feeding-conveying roller 20, it is corrected in attitude as the leading edge of the askew sheet S comes into contact with the nip which the pair of registration rollers 27 form. Then, the sheet S of recording medium is sent to the secondary transfer nip T with preset timing by the pair of registration rollers 27 while remaining pinched by the rollers 27. The image forming apparatus 100 is structured so that the sheet-feeding-conveying tray 19 can be inserted into, or moved out of, the main assembly of the image forming apparatus 100 from the front side (right side in FIG. 2) of the main assembly of the image forming apparatus 100.

Further, the image forming apparatus 100 is provided with a fixing apparatus 23, as a fixing means, which thermally fixes the toner image transferred onto the sheet S of recording medium, to the sheet S by heating and pressing the sheet S and the toner images thereon. The fixing apparatus 23 is disposed on the rear side (left side in FIG. 2) in the main assembly of the image forming apparatus 100. It comprises: a fixation unit 23*a*, which is provided with a fixation film; and a pressure roller 23*b*. While a sheet S of recording medium, onto which a toner image has just been transferred, is conveyed by a combination of the fixation unit 23*a* and pressure roller 23*b* while remaining pinched between the unit 23*a* and roller 23*b*, the toner image is heated and pressed. Consequently, the toner images become thermally fixed to the sheet S.

After the sheet S is discharged from the fixing apparatus 23, it is conveyed further downstream by a pair of discharge rollers 24 (discharge rollers 24*a* and 24*b*) while remaining pinched between the pair of rollers 24, and then, is discharged onto a delivery tray 25, which is a part of the top surface of the main assembly of the image forming apparatus 100. Moreover, the image forming apparatus 100 is provided with a front door 31, which is pivotally attached to the front side (right side in FIG. 2). Opening the front door 31 makes it possible for each cartridge P in the main assembly of the image forming apparatus 100 to be replaced.

<Image Forming Operation>

Next, referring to FIG. 2, an image forming operation to be carried out by the image forming apparatus 100 to form a full-color image on a sheet S of recording medium is described. The photosensitive drum 1 with which each cartridge P is provided is rotationally driven at a preset peripheral velocity in the counterclockwise direction of FIG. 2. In synchronism with this rotational driving of the photosensitive drum 1, the peripheral surface of the photosensitive drum 1 is uniformly charged to preset polarity and a preset potential level by the charge roller 2, with which each cartridge P is provided, with preset timing.

Then, each LED unit 11 exposes the peripheral surface of the corresponding photosensitive drum 1; it scans the peripheral surface of the photosensitive drum 1 with a beam of light it emits while modulating the beam with image formation signals for the corresponding color. Consequently, an electrostatic latent image which reflects the image formation signals is formed on the peripheral surface of the photosensitive drum 1. Then, the electrostatic latent image on the peripheral surface of each photosensitive drum 1 is supplied with toner (developer) by the development roller 3*a* with which each development unit 3 is provided. Consequently, the electrostatic latent image is developed into a visible image, that is, an image formed of toner (developer), which hereafter is referred to simply as a toner image (developer image).

Through the image formation process described above, a toner having yellow color, which is one of the primary color components of a full-color image, is formed on the peripheral surface of the photosensitive drum 1Y of the cartridge PY. As the primary transfer bias is applied to the development roller 3*a*Y by an unshown primary transfer bias power source, the toner image formed on the peripheral surface of the photosensitive drum 1Y is transferred (primary transfer)

onto the outward surface of the intermediary transfer belt 13, in the primary transfer nip T1Y of the cartridge PY.

On the peripheral surface of the photosensitive drum 1M of the cartridge PM, a toner image having magenta color, which also is one of the primary color components of a full-color image, is formed. As the primary transfer bias is applied to the development roller 3*a*M by the unshown primary transfer bias power source, the toner image formed on the peripheral surface of the photosensitive drum 1M is transferred (primary transfer) onto the outward surface of the intermediary transfer belt 13, in the primary transfer nip T1M of the cartridge PM, in such a manner that it is layered upon the yellow toner image which has just been transferred onto the outward surface of the intermediary transfer belt 13.

On the peripheral surface of the photosensitive drum 1C of the cartridge PC, a toner image having cyan color, which also is one of the primary color components of a full-color image, is formed. As the primary transfer bias is applied to the development roller 3*a*C by the unshown primary transfer bias power source, the toner image formed on the peripheral surface of the photosensitive drum 1C is transferred (primary transfer) onto the outward surface of the intermediary transfer belt 13, in the primary transfer nip T1C of the cartridge PC, in such a manner that it is layered upon the yellow and magenta toner images which have just been transferred in layers onto the intermediary transfer belt 13.

On the peripheral surface of the photosensitive drum 1K of the cartridge PK, a toner image having black color, which also is one of the primary color components of a full-color image, is formed. As the primary transfer bias is applied to the development roller 3*a*K by the unshown primary transfer bias power source, the toner image formed on the peripheral surface of the photosensitive drum 1K is transferred (primary transfer) onto the outward surface of the intermediary transfer belt 13, in the primary transfer nip T1K of the cartridge PK, in such a manner that it is layered upon the yellow, magenta, and cyan toner images which have just been transferred in layers onto the intermediary transfer belt 13. Consequently, the yellow, magenta, cyan, and black toner images are placed in layers on the outward surface of the intermediary transfer belt 13, yielding thereby an unfixed full-color toner image.

Meanwhile, the sheet-feeding-conveying roller 20 is rotationally driven with preset timing, whereby the sheets S of recording medium stacked in the sheet-feeder tray 19 are fed one by one into the main assembly of the image forming apparatus 100 by the coordination of the feed roller 20 and separation pad 21. Then, each sheet S is conveyed further by the pair of registration rollers 22 while remaining pinched between the pair of registration rollers 22. Then, it is introduced into the secondary transfer nip T2 with preset timing, and conveyed through the secondary transfer nip T2.

While the sheet S is conveyed through the secondary transfer nip T2, remaining pinched between the outward surface of the intermediary transfer belt 13 and the secondary transfer roller 27, the secondary transfer bias is applied to the secondary transfer roller 27 by an unshown secondary transfer bias power source. Consequently, the combination of the four monochromatic toner images, different in color, layered on the outward surface of the intermediary transfer belt 13, or the full-color toner image on the outward surface of the intermediary transfer belt 13, is transferred together (secondary transfer) onto the surface of the sheet S.

After the secondary transfer of the toner images onto the sheet S, the sheet S is separated from the outward surface of the intermediary transfer belt 13, and is introduced into the fixing apparatus 23 through a sheet passage 4, which conveyance guides form. Then, the sheet S is conveyed through a fixation nip Q, which the fixation unit 23*a* and pressure roller 23*b* of the fixing apparatus 23 form. While the sheet S, which is bearing the unfixed toner images, is conveyed through the fixation nip Q, the sheet S and the toner images thereon are heated and pressed by the combination of the fixation unit 23*a* and pressure roller 23*b*. Consequently, the toner images, different in color, melt and mix, and become fixed to the sheet S as they cool. Then, as the sheet S is discharged from the fixing apparatus 23, it is conveyed further by the pair of discharge rollers 24 while remaining pinched between the pair of rollers 24, and is discharged onto the delivery tray 25. The secondary transfer residual toner, which is the toner remaining on the outward surface of the intermediary transfer belt 13 after the secondary transfer, is removed by a cleaner 26 as a cleaning means.

<Light Emitting Unit>

Next, referring to FIG. 6, the LED unit 11, which is a light emitting unit, is described regarding its structure. Part (a) of FIG. 6 is a perspective view of the LED unit 11. It is for describing the structure of the LED unit 11. Part (b) of FIG. 6 is a sectional view of the LED unit 11. It also is for describing the structure of the LED unit 11. The LED unit 11 shown in parts (a) and (b) of FIG. 6 has LEDs 11*a*, a gradient index lens 11*b*, a circuit board 11*c*, a casing 11*d*, and a roller 11*e* as a rotational member. The LED unit 11 (light emitting unit) is attached to the tray 250. It is provided with multiple light emitting elements (light emitting diodes) which are for forming an electrostatic latent image, which is in accordance with the information of the image to be formed, on the peripheral surface of the photosensitive drum 1 (image bearing member). The light emitting elements (LEDs) are aligned in the direction parallel to the axial line of the photosensitive drum 1.

<Tray>

The roller 11*e* is rotatably supported by the casing 11*d*, by its axle. The lengthwise end portions of the casing 11*d* are provided with a pair of protrusive portions 11*f*, which fit one for one in a pair of grooves 250*a*R and 250*a*L, shown in part (a) of FIG. 5 (groove 250*a*L is unshown), with which the tray 250 is provided, in such a manner that the protrusive portions (casing 11*d*) are slidingly movable in the grooves. The direction in which the LEDs 11*a* are aligned is parallel to the lengthwise direction of the circuit board 11*c*. The LED unit 11 is also provided with multiple lenses 11*b*, which are aligned in the lengthwise direction of the casing 11*d*, in such a manner that they correspond in position to the LEDs 11*a*, one for one. The multiple LEDs 11*a* are supported by the circuit board 11*c*, whereas the lenses 11*b* and circuit board 11*c* are supported by the casing 11*d*.

The circuit board 11*c* is in electrical connection to the control portion 200 shown in FIG. 2. As for the operation for forming an electrostatic latent image, which is in accordance with the information of the image to be formed, on the peripheral surface of the uniformly charged portion of the peripheral surface of the photosensitive drum 1, each LED 11*a* is turned on or off by the control portion 200, according to the information of the image to be formed, which is inputted into the control portion 200 from the external host apparatus 400. Thus, the beam of light emitted from each LED 11*a* is focused on the peripheral surface of the photosensitive drum 1 through the lens 11*b*. Consequently, an electrostatic latent image which is in accordance with the information to be formed, is formed on the uniformly charged portion of the peripheral surface of the photosensitive drum 1.

<Tray>

Next, referring to FIG. 5, the tray 250 is described regarding its structure. Part (a) of FIG. 5 is a perspective view of the tray 250. It is for describing the structure of the tray 250. Part (b) of FIG. 5 is a perspective view of the combination of the tray, LED units 11 (11Y, 11M, 11C and 11K), and charge rollers 2 (2Y, 2M, 2C and 2K) after the attachment of the LED units 11 and charge rollers 2 to the tray 250. It is for describing the positional relationship among the tray 250, LED units 11, and charge rollers 2. Referring to part (b) of FIG. 5, the tray 250 is provided with the LED units 11 and charge rollers 2.

<Relationship Between Cartridge and Tray>

The image forming apparatus 100 is structured so that each LED unit 11 fits in the grooves 250*a*R and 250*a*L, shown in part (a) of FIG. 5 (groove 250*a*L is not shown), with which the tray 250 is provided, in such a manner that the protrusive portions 11*f*, shown in part (a) of FIG. 6, fit in the grooves 250*a*R and 250*a*L, one for one, in such a manner that they are allowed to slidingly move in the grooves 250*a*R and 250*a*L. Referring to part (b) of FIG. 5, there are provided a pair of compression springs 251R and 251L, which function as pressure applying means, between the tray 250 and LED unit 11. That is, the image forming apparatus 100 is structured so that the LED unit 11 (light emitting unit) is kept pressed toward the peripheral surface of the photosensitive drum 1 in each cartridge P, with its protrusive portions 11*f* remaining fitted in the grooves 250*a*R and 250*a*L, one for one.

Regarding the mounting of cartridges P into the tray 250, the tray 250 is provided with four cartridge chambers, the lengthwise end walls of which are parts of the side walls of tray 250. The right lengthwise end wall of each cartridge chamber is provided with a pair of grooves 250*e*R and 250*f*R as cartridge engaging portions, and the left lengthwise end wall of each cartridge chamber is provided with a pair of grooves 250*e*L and 250*f*L as cartridge engaging portions. Each cartridge P is to be inserted into the corresponding cartridge chamber in such a manner that the lengthwise end portions of the axle of the photosensitive drum 1 fit into the grooves 250*e*L and 250*e*R, one for one, and the lengthwise end portions of the axle of the development roller 3*a* fit into the grooves 250*f*L and 250*f*R, one for one. While each cartridge P is inserted into the tray 250 as described above, the peripheral surface of the photosensitive drum 1 (image bearing member) which is a part of the cartridge P, comes into contact with the roller 11*e*, as a rotational member, which is a part of the LED unit 11 and is rotatably supported by the LED unit 11. Thus, as the cartridge P is inserted further into the designated cartridge chamber in the tray 250, it settles into the preset position against the force generated by the pair of compression springs 251R and 250L (pressure applying means).

Thus, the LED unit 11 (light emitting unit) is kept in its preset position relative to the tray 250. Therefore, the distance (exposure distance) between the LED unit 11 and the peripheral surface of the photosensitive drum 1 is precisely maintained, making it possible for the image forming apparatus 100 to form high quality images.

As for each charge roller 2, it is rotatably supported by a pair of bearings 250*b*R and 250*b*L, shown in part (a) of FIG. 5, with which the tray 250 is provided, by its axle. The image forming apparatus 100 is structured so that the tray 250 can be pulled out of the main assembly of the image forming apparatus 100 in the frontward direction, although the tray 250 has to be moved upward before it can be moved frontward. Each charge roller 2 is attached to the tray 250. Thus, as the tray 250 is pulled out of the main assembly of the image forming apparatus 100, the charge roller 2 comes out of the main assembly with the tray 250. Therefore, the distance by which the tray 250 has to be moved upward to allow the tray 250 to be pulled out of the main assembly has only to be large enough to separate the photosensitive drum 1 from the outward surface of the intermediary transfer belt 13. In other words, this embodiment of the present invention makes it possible to reduce the main assembly of the image forming apparatus 100 in size.

<Cartridge>

Next, referring to FIG. 7, the cartridge P is described about its structure. Part (a) of FIG. 7 is a perspective view of the cartridge P. It is for describing the structure of the cartridge P. Part (b) of FIG. 7 is a sectional view of the cartridge P. It also is for describing the structure of the cartridge P. The cartridge P shown in parts (a) and (b) of FIG. 7 is provided with the developer storing portion 3*b* for holding toner (developer); a part of the casing of the cartridge P functions as the developer storing portion 3*b*. The main assembly of the image forming apparatus 100 and the cartridge P are structured so that when the cartridge P is in the main assembly, the developer storing portion 3*b* is on the top side of the photosensitive drum 1 (image bearing member). There is provided the development roller 3*a*, as a developer bearing member, in the developer storing portion 3*b*. The development roller 3*a* is positioned so that its peripheral surface squarely faces the peripheral surface of the photosensitive drum 1. In the developer storing portion 3*b* of each cartridge P, toner is stored; the four developer storing portions 3*b*Y, 3*b*M, 3*b*C and 3*b*K are different in the color of the toner they store.

Referring to part (a) of FIG. 7, the photosensitive drum 1 is rotatably supported by a pair of flanges 3*b*R and 3*b*L (flange 3*b*L is not shown). As for the development roller 3*a*, it is rotatably supported by a pair of flanges 3*a*R and 3*a*L (flange 3*a*L is not shown). One of the lengthwise ends of the axle of the photosensitive drum 1 is fitted with a coupling 1*a*, to which rotational driving force from a motor, as a driving force source, with which the main assembly of the image forming apparatus 100 is provided, is transmitted. One of the lengthwise ends of the axle of the development roller 3*a* is fitted with a coupling 3*d*, to which the rotational driving force from a motor, as a driving force source, with which the main assembly of the image forming apparatus 100 is provided, is transmitted.

<Relationship Between Cartridge and Tray>

Next, referring to FIG. 4, the relationship between the cartridges P and tray 250 after the insertion of the cartridges P into the tray 250 is described. Part (a) of FIG. 4 is a sectional view of a combination of the cartridges P and tray 250 after the insertion of the cartridges P into the tray 250. Part (b) of FIG. 4 is a perspective view of the combination of the cartridges P and tray 250 after the insertion of the cartridges P into the tray 250. The four cartridges PY, PM, PC and PK are the same in the manner in which they are inserted into the tray 250. Therefore, only the cartridge PK is described with regard to its insertion into the tray 250.

As the cartridge PK is vertically lowered into its designated chamber in the tray 250, the flange 3*b*KR which is rotatably supporting the right end of the photosensitive drum 1 of the cartridge PK, fits into the groove 250*e*KR (engaging portion), with which the tray 250 is provided. Further, the flange 3*a*KR which is rotatably supporting the right end of the development roller 3*a*, fits into the groove 250*f*KR (engaging portion), with which the tray 250 is provided. The flange 3*a*KR is grounded to the bottom surface 250*f*K1R of the groove 250*f*KR (engaging portion).

On the non-driving side of the cartridge PK, which is the opposite side from the driving side shown in FIG. 4*a*, the end surface of the cartridge P is provided with a pair of protrusive portions. As the cartridge PK is vertically lowered into its designated chamber in the tray 250, one of the pair of protrusive portions fits into the groove 250*e*KL (engaging portion), with which the tray 250 is provided. The other protrusive portion fits into the groove 250*f*KL (engaging portion) with which the tray 250 is provided, and becomes grounded to the bottom surface 250*f*K1L of the groove 250*f*kL. Thus, each cartridge P is kept in a preset attitude relative to the tray 250.

<Relationship Between Intermediary Transfer Unit and Tray>

Next, referring to FIGS. 3 and 4, positioning of the intermediary transfer unit 12 and tray 250 relative to each other is described. Part (a) of FIG. 3 is a perspective view of the intermediary transfer unit 12. It is for describing the structure of the intermediary transfer unit 12. Part (b) of FIG. 3 is a side view of a combination of the tray 250, cartridges P, intermediary transfer unit 12 when the tray 250 is in engagement with the intermediary transfer unit 12 after the complete insertion of the tray 250 into the main assembly of the image forming apparatus 100. The intermediary transfer unit 12 is fixed to the main assembly of the image forming apparatus 100. Referring to part (b) of FIG. 3 and part (b) of FIG. 4, the tray 250 is provided with four bosses 250*c*R, 250*d*R, 250*c*L and 250*d*L, and a pair of rails 250*g*R and 250*g*L.

Referring to part (a) of FIG. 3, the intermediary transfer unit 12 is provided with four pairs of receptacle portions 12*c*R, 12*d*R, 12*c*L and 12*d*L, into which the bosses 250*c*R, 250*d*R, 250*c*L and 250*d*L of the tray 250 fit, respectively. On the driving side, the boss 250*c*R fits into the receptacle portion 12*c*R, and the boss 250*d*R fits into the receptacle portion 12*d*R. On the non-driving side, the boss 250*c*L fits into the receptacle portion 12*c*L, and the boss 250*d*L fits into the receptacle portion 12*d*L. Thus, the tray 250 is precisely positioned relative to the intermediary transfer unit 12, making it possible for the image forming apparatus 100 to highly precisely carry out an image formation process.

<Insertion and Extraction of Tray>

As the developer in a cartridge P is consumed to such a degree that it becomes impossible for the cartridge P to form an image which is satisfactory in quality to the user who purchased the cartridge, the cartridge P loses its commercial value. Thus, each cartridge P is provided with an unshown detecting means for detecting the remaining amount of developer in the cartridge P. Based on the results of the detection by the detecting means, the control portion 200 compares the remaining amount of the developer in the cartridge P with a preset threshold value for predicting the remaining length of life of the cartridge P, and/or warning the user of the remaining length of life of the cartridge P.

If the control portion 200 determines that the remaining amount of developer in a given cartridge P has become smaller than the threshold value, it displays on the unshown screen of the display portion of the image forming apparatus 100, a message or warning regarding the remaining length of life of the cartridge P, to prompt the user to replace the cartridge P. If the user wants to replace the cartridge P, the user is to open the front door 31, shown in FIG. 1, which is attached to the main assembly of the image forming apparatus 100 so that it can be pivotally opened or closed, pull the tray 250 out of the main assembly in the direction indicated by an arrow mark A, remove the cartridge P upward from the tray 250, and replace the cartridge P with a replacement cartridge P.

Next, referring to FIGS. 8-10, the operational sequence, through which a given cartridge P can be moved from its image forming position shown in FIG. 2 to its position which is outside the main assembly of the image forming apparatus 100, and from which it can be extracted from the tray 250 to be replaced with a replacement cartridge, is described. Part (a) of FIG. 8 is a perspective view of a combination of the tray 250, four cartridges P (PY, PM, PC and PK), and front door 31, after the closing of the front door 31. Part (b) of FIG. 8 is a perspective view of the combination, when the front door 31 is fully open.

Part (a) of FIG. 9 is a phantom (see-through) side view of the image forming apparatus 100 after the closing of the front door 31. Part (b) of FIG. 9 is a phantom side view of the image forming apparatus 100 when the front door 31 is fully open. Part (c) of FIG. 9 is a phantom side view of the image forming apparatus 100 as seen from within the main assembly of the image forming apparatus after the closing of the front door 31. Part (d) of FIG. 9 is a phantom side view of the image forming apparatus 100 as seen from within the main assembly of the image forming apparatus 100 when the front door 31 is fully open. Part (a) of FIG. 10 is a phantom side view of the image forming apparatus 100 after the closing of the front door 31. It is for showing the position of a slide cam 42R after the closing of the front door 31. Part (b) of FIG. 10 is a phantom side view of the image forming apparatus 100 when the front door 31 is fully open. It is for showing the position of the slide cam 42R when the front door 31 is fully open.

Referring to parts (a) and (b) of FIG. 8, the four cartridges P are in the tray 250, being supported by the tray 250. If a user wants to pull the tray 250 out of the main assembly of the image forming apparatus 100, the user has to move the bosses 250*e*R, 250*d*R, 250*c*L and 250*d*L, shown in part (b) of FIG. 4, with which the bottom portion of the tray 250 is provided, out of the receptacle portions 12*c*R, 12*d*R, 12*c*L and 12*d*L (recesses), shown in part (a) of FIG. 3, with which the top portion of the intermediary transfer unit 12 is provided. Thus, the tray 250 has to be lifted to be upwardly separated from the intermediary transfer unit 12 so that it can be moved frontward of the main assembly of the image forming apparatus 100 after the opening of the front door 31.

Referring again to parts (a) and (b) of FIG. 8, the front door 31 is pivotally held to the main assembly of the image forming apparatus 100 by a pair of hinge portions 31*a*L and 31*a*R, with which the unshown frame of the main assembly of the image forming apparatus 100 is provided. The widthwise end portions of the front door 31 are provided with a pair of long holes 31*b*L and 31*b*R, one for one.

In the long holes 31*b*L and 31*b*R, the bosses 40*b*L and 40*b*R, with which one of the lengthwise ends of a linking member 40L, and the corresponding lengthwise end of a linking member 40R, are provided, are fitted in such a manner that the bosses 40*b*L and 40*b*R are allowed to slidingly move while being guided by the long holes 31*b*L and 31*b*R. That is, not only are the bosses 40*b*L and 40*b*R enabled to move along the long holes 31*b*L and 31*b*R, but also, to be allowed to rotationally move in the holes 31*b*L and 31*b*R, respectively. The hinge portions 40*a*L and 40*a*R, with which the opposite ends of the linking members 40L and 40R from the long holes 31*b*L and 31*b*R are provided, respectively, are rotatably supported by the unshown frame of the main assembly of the image forming apparatus 100.

Hereafter, the structure of the tray 250 is described referring to primarily the driving side of the tray 250. Since the structure of the non-driving side of the tray 250 is similar to that of the driving side, the portions of the non-driving side of the tray 250, which are similar in structure to those on the driving side, are not described. Referring to part (d) of FIG. 9, the boss 40*c*R, with which one of the lengthwise end portions of the linking member 40R is provided, is fitted in the long hole 41*a*R, with which the slide link 41R is provided. That is, the linking member 40R is rotatably supported by the slide link 41R in such a manner that the boss 40*c*R is allowed to move along the long hole 41*a*R. The slide link 41R is supported so that it is allowed to move in the front-rear direction (left or right direction in parts (a) and (b) of FIG. 9), relative to the right side plate 50R, which is fixed to the main assembly of the image forming apparatus 100.

Referring to parts (a)-(d) of FIG. 9, the bosses 42*a*R and 42*b*R, with which the slide cam 42R is provided, are fitted in the long holes 41*b*R and 41*c*R, with which the slide link 41R is provided, in such a manner that the former is allowed to slide along the latter. That is, the slide cam 42R is supported so that it is allowed to move upward or downward (parts (c) and (d) of FIG. 9) along the long holes 41*b*R and 41*c*R, respectively. Next, referring to parts (a) and (b) of FIG. 10, the right plate 50R is provided with a pair of long holes 50*a*R and 50*b*R, which are roughly in the form of a letter Z. It is in these long holes 50*a*R and 50*b*R that the bosses 42*a*R and 42*b*R of the slide cam 42R are fitted so that they are allowed to slide along the long holes 50*a*R and 50*b*R, respectively. That is, the slide cam 42R is supported in such a manner that it is allowed to move along the Z-shaped long holes 50*a*R and 50*b*R, that is, horizontally as well as diagonally.

As the front door 31 is changed in state from the one in which it is remaining closed as shown in part (a) of FIG. 8, to the one in which it is fully open as shown in part (b) of FIG. 8, it pivotally moves about the hinge portions 31*a*L and 31*b*L, causing thereby the bosses 40*b*L and 40*b*R to slide along the lengthwise edges of the long holes 31*b*L and 31*b*R, respectively, with which the widthwise end portions of the front door 31 are provided one for one, and also, causing the linking members 40L and 40R to rotationally move about the hinge portions 40*a*L and 40*a*R, respectively. Further, the boss 40*c*R, shown in part (d) of FIG. 9, with which a part of the linking member 40R is provided, rotationally move frontward about the hinge portion 40*a*R. Thus, the slide link 41R moves frontward, following the long hole 41*a*R, in which the boss 40R is fitted, as shown in part (d) of FIG. 9.

As the slide link 41R moves frontward, the slide cam 42R is moved frontward by the bosses 42*a*R and 42*b*R fitted in the long holes 41*b*R and 41*c*R, respectively, of the slide link 41R. The bosses 42*a*R and 42*b*R of the slide cam 42R are also fitted in the long holes 50*a*R and 50*b*R, respectively, with which the right side plate 50R, shown in part (a) of FIG. 10, is provided. Therefore, as the slide cam 42R is moved frontward, its bosses 42*a*R and 42*b*R are made to climb the slanted surfaces 50*a*1R and 50*b*1R of the Z-shaped long holes 50R and 50*b*R, respectively, with which the right side plate 50R is provided. Thus, not only is the slide cam 42R moved frontward (rightward in part (d) of FIG. 9, but also, upward, as shown in part (d) of FIG. 9.

Part (a) of FIG. 11 is a perspective view of a combination of the driving system and linking member 43R, and their adjacencies, when the front door 31 is remaining completely closed. It is for describing the structure of the combination. Part (b) of FIG. 11 is a perspective view of the combination, when the front door 31 is fully open. It is also for describing the structure of the combination.

Part (a) of FIG. 12 is a side view of a combination of the right end portion of the tray 250, right side plate 50R, right slide link 40R, right linking member 43R, driving system, and their adjacencies, when the charge roller 2, photosensitive drum 1, and development roller 3*a*, with which the tray 250 is provided, are in connection to their power sources. It is for describing how the driving force is transmitted to the cartridges P and the components attached to the tray 250. Part (b) of FIG. 12 is a side view of the combination shown in part (a) of FIG. 12 when the charge roller 2, photosensitive drum 1, and development roller 3*a*, with which the tray 250 is provided, are not in connection to their power sources.

Referring to parts (a) and (b) of FIG. 11, the slide link 41R is provided with the linking member 43R, by which one of the lengthwise ends of each of levers 80K, 81K, and 82K is supported in such a manner that the levers 80K, 81K, and 82K are allowed to pivotally move about their pivots by which they are attached to the linking member 43R, one for one. The other lengthwise end of the lever 81K is connected to a drum cam 71K by a pin with which the other lengthwise end portion of the lever 81 is provided, in such a manner that the drum cam 71K is allowed to rotationally move about the pin. The other lengthwise end portion of the lever 80 is connected to a charge roller cam 71K by a pin with which the other lengthwise end portion of the lever 80 is provided, in such a manner that the charge roller cam 71K is allowed to rotationally move about the pin. Further, the other lengthwise end of the lever 82K is connected to a development roller cam 72K by a pin with which the lengthwise end portion of the lever 82 is provided, in such a manner that the development roller cam 71K is allowed to rotationally move about the pin.

As the front door 31, which is remaining closed as shown in part (a) of FIG. 11 is opened as shown in part (b) of FIG. 11, the slide link 41R is made to pivotally move frontward about the hinge portions 40*a*L and 40*a*R, by the movement of the front door 31, as shown in part (d) of FIG. 9. Thus, the boss 40*c*R with which the slide link 41R is provided, pivotally moves frontward with the slide link 41R. As a result, the slide link 41R moves frontward by being guided by the long hole 41*a*R, in which the boss 40*c*R is fitted.

Thus, the drum cam 71K, charge roller cam 70K, and development roller cam 72K are made to rotationally move by the levers 80K, 81K and 82K, respectively, which are rotatably supported by the linking member 43R, by their axle. As they rotationally move, the surfaces 71*a*, 70*a* and 72K of the drum cam 71*a*, charge roller cam 70K, and development roller cam 72K, respectively, change in rotational phase (position in terms of the rotational direction of the rollers).

Consequently, the surface 61*a* of the gear 61K, shown in part (a) of FIG. 12, which has been in contact with the surface 71*a* of the drum cam 71K, comes into contact with the surface 71*b*, shown in part (b) of FIG. 12, and slides on the surface 71*b* while pushing the surface 61*a* rightward. Thus, the gear 61K is disengaged from the coupling 1*a*, shown in part (a) of FIG. 7, of the photosensitive drum 1, making it impossible for the driving force from the motor to be transmitted to the photosensitive drum 1.

Similarly, the surface 60*a* of the gear 60K, shown in part (a) of FIG. 12, which has been in contact with the surface 70*a*, comes into contact with the surface 70*b*, shown in part (b) of FIG. 12, and slides on the surface 70*b* while pushing the surface 70*b* rightward. Thus, the gear 60K moves rightward in part (b) of FIG. 12. Consequently, the gear 60K is disengaged from the unshown coupling of the charge roller 2, making it impossible for the driving force from the motor to be transmitted to the charge roller 2.

Similarly, the surface 62*a*, shown in part (a) of FIG. 12, of the gear 62K, which has been in contact with the surface 70*a* of the charge roller cam 70K comes into contact with the surface 72*b*, shown in part (b) of FIG. 12, and slides on the surface 72*b* while pushing the surface 62*a*. Thus, the gear 62K moves rightward. Therefore, the gear 62K disengages from the coupling 3*d* of the development roller 3*a*, making it impossible for the driving force from the motor to be transmitted to the development roller 3*a*. Therefore, it becomes possible for the tray 250 to be pulled out of the main assembly of the image forming apparatus 100 in the frontward direction.

Referring to FIG. 2, when the front door 31 is remaining closed, the tray 250 is in engagement with the intermediary transfer unit 12. While the tray 250 is in engagement with the intermediary transfer unit 12, as shown in part (a) of FIG. 12, the surface 42*e*R of the slide cam 42R is not in contact with the rail 250*g*R, with which the bottom portion of the tray 250 is provided. As the front door 31 is opened while the surface 42*e*R of the slide cam 42R is not in contact with the rail 250*g*R, the slide cam 42R is moved upward by the movement of the door 31 as described above. Therefore, the surface 42*e*R of the slide cam 42R comes into contact with the rail 250*g*R with which the bottom portion of the tray 250 is provided. Then, it pushes the tray 250 upward, causing thereby the tray 250 to move upward. Consequently, the tray 250 is separated from the intermediary transfer unit 12.

As the tray 250 is separated from the intermediary transfer unit 12, the charge roller 2, photosensitive drum 1, and development roller 3*a*, with which the tray 250 is provided, become disengaged from the means through which the driving force is transmitted to them. How the driving force is transmitted, or prevented from being transmitted, to the charge rollers 2, photosensitive drum 1, and development roller 3*a* is similar to how the driving force is transmitted, or prevented from being transmitted, to cartridges P. Thus, in order to avoid the repetition of the same descriptions, only the transmission of the driving force to the cartridge PK, and the prevention of the transmission of the driving force to the cartridge PK, are described. Referring to part (a) of FIG. 12, to the photosensitive drum 1, the driving force is transmitted by the engagement (coupling) of a drum gear with which the photosensitive drum 1 is provided, with the gear 61K. To the charge roller 2, the driving force is transmitted by the engagement (coupling) of a charge roller gear, with which the charge roller 2 is provided, with a gear 60K. To the development roller 3*a*, the driving force is transmitted by the engagement (coupling) of the development roller gear, with which the development roller 3*a* is provided, with the gear 62K.

The gear 61K, through which the driving force is inputted to the photosensitive drum 1, is provided with a cam surface 61*a*. The cam surface 61*a* of the gear 61K is in contact with the cam surface 71*a* of the drum cam 71K. The gear 60K, through which the driving force is inputted to the charge roller 2, is provided with a cam surface 60*a*. The cam surface 60*a* of the gear 60K is in contact with the cam surface 70*a* of the charge roller cam 70K. The gear 62K, through which the driving force is inputted to the development roller 3*a*, is provided with a cam surface 62*a*. The cam surface 62*a* of the gear 62K is in contact with the cam surface 71*a* of the development roller cam 72K.

<Insertion and Extraction of Cartridge>

Next, referring to FIG. 13, the operation for inserting the cartridge P into the tray 250 is described. Part (a) of FIG. 13 is a side view of a combination of a part of the tray 250, and the cartridge PK, as seen from the driving side, when the cartridge PK is about to be inserted into the tray 250. Part (b) of FIG. 13 is a side view of the combination, as seen from the driving side, during the insertion. Part (c) of FIG. 13 is a side view of the combination, as seen from the driving side, after the insertion. Part (d) of FIG. 13 is a side view of the combination, as seen from the non-driving side, when the cartridge PK is about to be inserted into the tray 250. Part (e) of FIG. 13 is a side view of the combination, as seen from the non-driving side, during the insertion. Part (f) of FIG. 13 is a side view of the combination, as seen from the non-driving side, after the insertion.

Referring to parts (a)-(f) of FIG. 13, if it is necessary to insert the cartridge PK into the tray 250, the tray 250 has to be pulled out of the main assembly of the image forming apparatus 100 in the frontward direction, so that the cartridge PK can be vertically inserted into the tray 250, in the downward direction (in parts (a)-(f) of FIG. 13). As the cartridge PK is inserted into the tray 250, the LED unit 11 (light emitting unit) moves in the direction (leftward in parts (a)-(f) of FIG. 13) which is perpendicular to the direction in which the cartridge PK is inserted. That is, the tray 250 and LED unit 11K are structured so that as the cartridge PK is inserted into the tray 250, the LED unit 11K (light emitting unit) is moved out of the area through which the cartridge PK is inserted into, or extracted from, the tray 250.

Since the tray 250 and cartridge PK are structured so that the latter can be inserted into, or extracted from, the former, the cartridge PK in the tray 250 can be replaced with another black cartridge PK. The operations for replacing the cartridges in the tray 250 other than the cartridge PK is the same as the operation for replacing the cartridge PK. Thus, only the operation for replacing the cartridge PK in the tray 250 is described. Referring to part (a) of FIG. 13, as the cartridge PK is inserted into the tray 250, the flange 3*b*KR, which is rotatably supporting the photosensitive drum 1, comes into contact with a guiding portion 250*e*K1R, which is a combination of the lateral surfaces of the groove 250*e*KR (engaging portion) of the tray 250, and slidingly moves on the guiding portion 250*e*K1R.

Thus, the photosensitive drum 1 is prevented from moving in the front-rear direction, being allowed to move only in the vertical direction relative to the tray 250. In this embodiment, the LED unit 11 is employed as an exposing apparatus. The gradient index lens for focusing the light from the LED unit 11 is short in focal distance. Therefore, the LED unit 11 has to be positioned close to the peripheral surface of the photosensitive drum 1.

Referring to part (a) of FIG. 13, the only direction in which the flange 3*b*KR, which is rotatably supporting the photosensitive drum 1K, can be inserted into the groove 250*e*KR (engaging portion) of the tray 250 is the vertical direction. Therefore, it is possible to prevent the peripheral surface of the photosensitive drum 1 from coming into contact with the lens 11*b* of the LED unit 11, and other elements such as electrical elements. Further, there is only one direction, that is, vertical direction, in which a user is required to move the cartridge PK in order to insert the cartridge PK into, or extract the cartridge PK from, the tray 250. Therefore, it does not occur that a user becomes confused regarding the direction in which the cartridge PK is inserted, or extracted.

Next, referring to part (b) of FIG. 13, as the flange 3*b*KR is inserted into the groove 250*e*KR (engaging portion) of the tray 250 by a certain distance, the peripheral surface of the photosensitive drum 1 with which the cartridge PK is provided, comes into contact with the roller 11*e* of the LED unit 11 with which the tray 250 is provided.

In this embodiment, the image forming apparatus 100 is structured so that the beam of light for exposing the peripheral surface of the photosensitive drum 1 is roughly horizontally emitted by the LED unit 11. Thus, the contact between the peripheral surface of the photosensitive drum 1 and the peripheral surface of the roller 11*e* precisely keeps the distance between the peripheral surface of the photosensitive drum 1 and the surface 11*b*1 of the lens 11*b* of the LED unit 11, making it possible for the image forming apparatus 100 to form high quality images. As the cartridge PK is further inserted into the tray 250 so that its flange 3*b*KR is further inserted into the groove 250*e*KR (engaging portion), the LED unit 11 is moved frontward (leftward in FIG. 13) of the main assembly of the image forming apparatus 100 by the roller 11*e* which is in contact with the peripheral surface of the photosensitive drum 1, against the resiliency of a pair of compression springs 251R and 251L shown in part (b) of FIG. 5.

Referring to part (c) of FIG. 13, as the cartridge PK is inserted all the way into the tray 250, the flange 3*b*KR, which is rotatably supporting the photosensitive drum 1, comes into contact with the bottom surface 250*e*K2R of the groove 250*e*KR (engaging portion). Further, the flange 3*a*KR, which is rotatably supporting the development roller 3*a*, comes into contact with the bottom surface 250*fk*1R of the groove 250*fk*R (engaging portion) of the tray 250. Consequently, the cartridge PK is precisely positioned relative to the tray 250.

When the cartridge PK and tray 250 are in the state shown in part (c) of FIG. 13, the LED unit 11 will have been moved by the roller 11*e*, which is in contact with the peripheral surface of the photosensitive drum 1, out of the area through which the cartridge PK is inserted into, or extracted from, the tray 250. Further, the LED unit 11 will have come under the pressure generated by the pair of compression springs 251R and 251L, shown in FIG. 5, in the direction parallel to the rotational axis of the photosensitive drum 1. Therefore, its distance from the photosensitive drum 1 is highly precisely maintained.

By following the operational sequence shown in parts (a)-(f) of FIG. 13, a user can properly place the cartridge PK in the tray 250, or extract the cartridge PK from the tray 250, through a simple action, that is, by inserting the cartridge PK into, or extracting the cartridge PK, in the vertical direction. Therefore, a user is enabled to insert the cartridge PK into the tray 250, or extract the cartridge PK from the tray 250, without being concerned with operational errors. Further, the user is allowed to insert each cartridge P into, or extract each cartridge P from, the tray 250, in the vertical direction. Therefore, the image forming apparatus 100 is minimized in the distance by which each process cartridge P has to be moved to be inserted into, or extracted from, the tray 250.

For example, if an image forming apparatus is structured so that when each cartridge P is inserted or extracted, it has to be changed at least once in the direction in which it is moved, a user has to change the direction in which the user applies force to insert or extract the cartridge P at the point at which the cartridge P has to be changed in the direction in which it is to be pushed or pulled. In this embodiment, there is only one direction (vertical direction) in which the cartridge P can be inserted into, or extracted from, the tray 250. Therefore, a user is not required to change the direction in which the user applies force to the cartridge P during the operation for inserting the cartridge P into, or extracting the cartridge P from, the tray 250. In other words, this embodiment can reduce the distance a cartridge P has to be moved to be inserted into, or extracted from, the tray 250, and also, can reduce the amount of stress to which the user is likely to be subjected when the user has to insert a cartridge P into the tray 250, or replace the cartridge P in the tray 250.

Further, referring to part (f) of FIG. 13, it is to the tray 250 that the charge roller 2, which is the means for charging the peripheral surface of the photosensitive drum 1 (image bearing member), is attached. Moreover, the image forming apparatus 100 is structured so that after the complete insertion of the cartridge PK into the tray 250, that is, the complete insertion of the flanges 3*a*R, 3*b*R, 3*a*L and 3*b*L into the grooves 250*e*KR, 250*f*KR, 250*e*KL and 250*f*KL, respectively, the peripheral surface of the photosensitive drum 1 is in contact with the peripheral surface of the charge roller 2. Thus, as the tray 250 is inserted into the main assembly of the image forming apparatus 100 after the insertion of the cartridge PK, the peripheral surface of the photosensitive drum 1 comes into contact with the outward surface of the intermediary transfer belt 13, making it possible for the image forming apparatus 100 to form images.

According to this embodiment, the LED unit 11, which can contribute to the size reduction of an image forming apparatus, is employed as the exposing apparatus for the image forming apparatus 100, in order to provide the image forming apparatus which employs a cartridge drawer (tray 250, for example), and yet, is excellent in usability in terms of the operation for inserting a cartridge into the main assembly of an image forming apparatus, or extracting a cartridge from the main assembly. Further, all that is necessary to be done to insert a cartridge into the tray 250, or extract a cartridge from the tray 250, is to move the cartridge vertically downward, or vertically upward after the tray 250 is completely pulled out of the apparatus main assembly.

Embodiment 2

Further, the image forming apparatus 100 is structured so that when the cartridge PK is inserted into the tray 250, or extracted from the tray 250, the LED unit 11 supported by the tray 250 remains outside the area through which photosensitive drum 1 moves as the cartridge is inserted or extracted. Therefore, it is unnecessary for the LED unit 11 to be retracted into the apparatus main assembly 100 when the tray 250 is pulled out of the apparatus main assembly 100. Thus, this embodiment can contribute to the size reduction of the image forming apparatus 100. Further, this embodiment makes it unnecessary for a user to change the direction in which a cartridge P is to be pressed during the insertion of the cartridge P into the tray 250, or the extraction of the cartridge P from the tray 250, making it possible for the user to insert the cartridge P into the tray 250, or extract the cartridge P from the tray 250, without being concerned with insertion or extraction errors. Moreover, compared to an image forming apparatus structured so that when a cartridge is inserted into, or extracted from, its tray 250, the apparatus has to be changed at least once in the direction in which the cartridge is pressed or pulled, the image forming apparatus 100 in this embodiment is substantially shorter in the distance by which the cartridge P has to be moved to be inserted into, or extracted from, the tray 250.

In a case of an image forming apparatus structured so that when a cartridge P is inserted into, or extracted from, the tray 250 of the apparatus, it changes at least once in the direction in which the cartridge P is inserted or extracted, it becomes sometimes necessary for a user to change the direction in which the user presses the cartridge P during the insertion of the cartridge P, or pulls the cartridge P during the extraction of the cartridge P. In comparison, in the case of the image forming apparatus 100 in this embodiment, there is only one direction (vertical direction) in which a cartridge P has to be moved during its insertion into the tray 250, or extraction from the tray 250. Therefore, it is unnecessary for a user to change the direction in which the user has to apply force to the cartridge P during the insertion or extraction of the cartridge P. Thus, this embodiment can reduce an image forming apparatus in the distance by which a cartridge has to be moved to be inserted into, or extracted from, the tray of the apparatus. Further, this embodiment makes it unnecessary for a user to change the direction in which the user presses a cartridge P during the insertion of the cartridge P, or pulls the cartridge P during the extraction of the cartridge P. Thus, this embodiment can reduce the amount of stress to which the user is subjected during the insertion or extraction of the cartridge P.

Embodiment 2

Next, referring to FIGS. 14 and 15, the image forming apparatus in the second embodiment of the present invention is described regarding its structure. By the way, the portions of the image forming apparatus in this embodiment, which are the same in structure as the counterparts of the image forming apparatus 100 in the first embodiment, are given the same referential characters as those given to the counterparts, or the same names (which may be different in referential character) as those given to the counterparts, and are not described. FIG. 14 is a sectional view of the image forming apparatus in the second embodiment of the present invention. It is for describing the structure of the apparatus.

<Image Forming Apparatus>

Referring to FIG. 14, in the case of the image forming apparatus 100 in this embodiment, each of the four secondary transfer nips T1 is formed by the photosensitive drum 1, with which each cartridge P is provided, and one of the four primary transfer rollers 17, which are primary transferring means. This image forming apparatus is an example of image forming apparatus which is provided with an intermediary transfer belt 13 (ITB: Intermediate Transfer Belt) which is for conveying a sheet S of recording medium to the primary transfer nip T1.

Referring to FIG. 2, in the first embodiment described above, the image forming apparatus 100 was structured so that the toner image formed on the peripheral surface of each photosensitive drum 1 is transferred (primary transfer) onto the intermediary transfer belt 13 (ITB: Intermediate Transfer Belt). However, the present invention is also applicable to such an image forming apparatus as the image forming apparatus 100, shown in FIG. 14, which employs an ETB (electrostatic transportation belt). The image forming apparatus 100 of the ETB type, shown in FIG. 4, is the same in structure and image forming operation, except for the structure of its conveyance unit 212, as the image forming apparatus of the ITB type, shown in FIG. 2. Therefore, the portions of the image forming apparatus in this embodiment, which are the same in structure as the counterparts of the image forming apparatus 100 in the first embodiment, are not described to avoid the repetition of the same descriptions.

In the case of the conveyance unit 212 shown in FIG. 14, an electrostatic conveyance belt 213 (ETB) is suspended and tensioned by a driver roller 14 and a tension roller 16, in such a manner that it is rotationally movable in the counterclockwise direction of FIG. 14. There are provided four primary transfer rollers 17, which are primary transferring means, on the inward side of the loop which the electrostatic conveyance belt 213 forms. The electrostatic conveyance belt 213 (conveyance belt) for conveying a sheet S of recording medium is disposed in such a manner that as the sheet S is conveyed by the electrostatic conveyance belt 213, the sheet S is kept by the electrostatic conveyance belt 213, in contact with the peripheral surface of the photosensitive drum 1 (image bearing member) which is in its preset image formation position in the main assembly of the image forming apparatus 100.

The sheets S of recording medium stored in the sheet feeder tray 19 of the sheet-feeding-conveying unit 18 are fed one by one into the apparatus main assembly 100 by the sheet-feeding-conveying roller 20 while being separated from the rest in the tray 19 by the coordination between the roller 20 and a separation pad 21. Then, each sheet S is conveyed by the sheet-feeding-conveying roller 20 to the nip between a pair of registration rollers 22 while the registration rollers 22 are remaining stationary. As the leading edge of the sheet S collides with the nip, it is corrected in attitude if the sheet S is askew. Then, the registration rollers 22 begin to be rotationally driven with preset timing. Thus, the sheet S is conveyed by the registration rollers 22 along a sheet conveyance guide 5, to be delivered to the electrostatic conveyance belt 213. As it is delivered to the electrostatic conveyance belt 213, it is electrostatically adhered to the belt 213, and is conveyed further by the belt 213.

Each of the four cartridges P held in the tray 350 is provided with the photosensitive drum 1 as an image bearing member. The photosensitive drum 1 in this embodiment rotates in the clockwise direction of FIG. 14. The peripheral surface of the photosensitive drum 1 is uniformly charged by the charge roller 2 with which the tray 350 is provided. The uniformly charged portion of the peripheral surface of the photosensitive drum 1 is scanned by (exposed to) the beam of light emitted by the LED unit 11, as an exposing means, while being modulated according to the information of the image to be formed. Consequently, an electrostatic latent image is formed on the peripheral surface of the photosensitive drum 1. Then, the electrostatic latent image on the peripheral surface of the photosensitive drum 1 is supplied with toner by the development roller 3*a*. As a result, the electrostatic latent image is developed.

As the sheet S, which is being conveyed by the electrostatic conveyance belt 213 while being electrostatically adhered to the belt 213, arrives at the primary transfer nip T1, the primary transfer bias begins to be applied to the primary transfer roller 17 from an unshown primary transfer bias power source. Thus, the four toner images formed on the peripheral surfaces of the four photosensitive drums 1, one for one, are sequentially transferred in layers onto the sheet S, in the primary transfer nip T1.

After the four toner images on the peripheral surfaces of the four photosensitive drums 1, one for one, are transferred in layers onto the sheet S, the sheet S is conveyed to the fixing apparatus 23, which is provided with the fixation unit 23*a* and pressure roller 23*b*, along the sheet conveyance guide 6, to be conveyed through the fixing apparatus 23. As the sheet S is conveyed through the fixing apparatus 23 while remaining sandwiched by the fixation unit 23*a* and pressure roller 23*b*, the sheet S and the toner images thereon are heated and pressed by the fixation unit 23*a* and pressure roller 23*b*. Consequently, the toner images become fixed to the sheet S (thermal fixation). Thereafter, the sheet S is discharged onto the delivery tray 25 by the pair of discharge rollers 24.

The image forming apparatus 100, shown in FIG. 14, which employs an electrostatic transportation belt, can also be structured so that a cartridge P can be inserted or extracted as it can be in the case of the image forming apparatus 100 in the first embodiment. Part (a) of FIG. 15 is a side view of a combination of the cartridge PK, and the part of the tray 350, which is for the cartridge PK, when the cartridge PK is about to be inserted into the tray 350. Part (b) of FIG. 15 is a side view of the combination, as seen from the driving side, during the insertion of the cartridge PK into the tray 350. Part (c) of FIG. 15 is a side view of the combination, as seen from the driving side, after the insertion of the cartridge PK into the tray 350. Part (d) of FIG. 15 is a side view of the combination, as seen from the non-driving side, when the cartridge PK is about to be inserted into the tray 350. Part (e) of FIG. 15 is a side view of the combination, as seen from the non-driving side, during the insertion of the cartridge PK into the tray 350. Part (f) of FIG. 15 is a side view of the combination, as seen from the non-driving side, after the insertion of the cartridge PK into the tray 350.

If a user wants to install the cartridge PK in the main assembly of the image forming apparatus 100, or uninstall the cartridge PK from the main assembly of the image forming apparatus 100, the user is to open the front door 31 shown in FIG. 14, and to move the tray 350 out of the main assembly of the image forming apparatus 100. With the tray 350 being out of the main assembly of the image forming apparatus 100, the cartridge PK can be inserted into, or extracted from, the tray 350. Also in this embodiment, the LED unit 11 is disposed so that a beam of light is horizontally emitted from the unit 11 to expose the peripheral surface of the photosensitive drum 1, as in the first embodiment. The four cartridges P are the same in the operation through which they are replaced while they are in the tray 350. Therefore, it is only the operation for replacing the cartridge PK in the tray 350 that is described, with reference to parts (a)-(f) of FIG. 15.

The operation for inserting a cartridge P into the tray 350 of the image forming apparatus 100, shown in FIG. 14, which employs an ETB (electrostatic transportation belt) 213, and the operation for extracting the cartridge P in the tray 350, are similar to those carried out by the image forming apparatus 100, shown in FIG. 2, which employs an ITB (intermediate transfer belt). Referring to part (a) of FIG. 15, a user is to insert the cartridge PK into its designated position in the tray 350. As the cartridge PK is inserted, a flange 360*b*KR, by which the photosensitive drum 1 is rotatably supported, enters the groove 350*e*KR (engaging portion), with which the tray 350 is provided, and comes into contact with a guide 350*e*K1R made up of the side walls of the groove 350*e*KR (engaging portion). As for a flange 360*a*KR, by which the development roller 3*a* is rotatably supported, it enters the groove 350*f*KR (engaging portion), with which the tray 350 is provided.

Thus, the photosensitive drum 1 is regulated in the front-rear movement, being allowed to move only in the vertical direction relative to the tray 350. That is, the image forming apparatus 100 is structured so that there is only one direction, or the vertical direction, in which the photosensitive drum 1 can be inserted into, or extracted from, the tray 350. Therefore, the peripheral surface of the photosensitive drum 1 is prevented from coming into contact with the lens 11*b* of the LED unit 11, and/or other electro-mechanical elements. Since there is only one direction, the vertical direction, that the cartridge PK can be inserted into, or extracted from, the tray 350, a user can insert, or extract, the cartridge PK, with no hesitation.

Referring to part (b) of FIG. 15, as the cartridge PK is inserted into the tray 350 by a certain distance, the flanges 360*b*KR and 360*a*KR enter the grooves 350*e*KR and 350*f*KR (engaging portions) of the tray 350, making the peripheral surface of the photosensitive drum 1 come into contact with the roller 11*e* of the LED unit 11. In this embodiment, the LED unit 11 is disposed so that the beam of light for exposing the peripheral surface of the photosensitive drum 1 is horizontally emitted by the LED unit 11.

The contact between the roller 11*e* and the peripheral surface of the photosensitive drum 1 highly accurately keeps the distance between the peripheral surface of the photosensitive drum 1 and the lens 11*b* of the LED unit 11, making it possible for the image forming apparatus 100 to form images of high quality. As the cartridge PK is further inserted into the tray 350, the flanges 360*b*KR and 360*a*KR, by which the photosensitive drum 1 and development roller 3*a* are axially supported, are made to enter further into the groove 350*e*KR and 350*f*KR (engaging portions), respectively. Thus, the roller 11*e*, with which the peripheral surface of the photosensitive drum 1 is in contact, causes the LED unit 11 to move rearward (rightward of FIG. 15) of the main assembly of the image forming apparatus 100.

Next, referring to part (c) of FIG. 15, as the cartridge PK is completely inserted into the tray 350, the flange 360*b*KR is completely inserted into the grooves 350*e*KR (engaging portions) of the tray 350, coming into contact with the bottom surfaces 350K2R. Further, the flange 360*a*KR, by which the development roller 3*a* is supported, comes into contact with the bottom surface 350*f*K1R of the groove 350*f*KR (engaging portion) of the tray 350. Consequently, the cartridge PK becomes fixed in position.

Referring to part (f) of FIG. 15, as the cartridge PK is inserted into its designated position in the tray 350, the peripheral surface of the photosensitive drum 1 comes into contact with the roller 11*e*, shown in parts (a) and (b) of FIG. 6, and presses on the roller 11*e*. Thus, the LED unit 11 is made to retreat out of the area through which the cartridge PK is inserted into, or extracted from, the tray 350, against the resiliency of the pair of compression springs 251R and 251L shown in part (b) of FIG. 5. As the LED unit 11 is pressed against the resiliency of the compression springs 251R and 251L, it is pressed toward the rotational axis of the photosensitive drum 1 by the compression springs 251R and 251L. Thus, the distance between the peripheral surface of the photosensitive drum 1 and the surface 11*b*1 of the lens 11*b* of the LED unit 11 is highly precisely maintained.

By following the operational sequence shown by parts (a)-(f) of FIG. 15, a user can install the cartridge PK into the tray 350 by moving the cartridge PK simply downward (vertical direction), or uninstall the cartridge PK from the tray 350 by moving the cartridge PK simply upward (vertical direction). Thus, the user can safely insert the cartridge PK into the tray 250, or extract the cartridge PK from the tray 350, with no hesitation. Since the direction in which the cartridge PK is inserted into the tray 350, or extracted from the tray 350, is vertical to the tray 350, the image forming apparatus 100 is shorter in the distance by which the cartridge PK has to be moved to be inserted into, or extracted from, the tray 350, than that in any conventional image forming apparatus.

For example, in the case of an image forming apparatus structured so that when the cartridge PK is inserted into the cartridge tray, or extracted from the cartridge tray, the cartridge PK has to be changed at least once in the direction in which it is inserted or extracted, a user has to change at least one direction in which the user applies force to the cartridge PK. In this embodiment, however, the cartridge PK does not need to be changed in the direction in which it is inserted or extracted, while it is inserted or extracted. Therefore, it is unnecessary for the user to change the direction in which the user applies force to the cartridge PK, when the user inserts or extracts the cartridge PK. That is, this embodiment also can reduce the distance by which the cartridge PK has to be moved to be inserted into, or extracted from, the tray. Further, it makes it unnecessary for the user to change the direction in which the user applies force to the cartridge PK, during the insertion or extraction of the cartridge PK. Thus, it can reduce the amount of the stress to which the user is subjected when the user has to insert a cartridge P into, or extract the cartridge P from, the cartridge tray.

Referring to FIG. 15, when the flanges 360*b*KR, 360*a*KR, 360*b*KL and 360*a*KL of the cartridge PK are all the way in the grooves (engaging portions) 350*e*KR, 350*f*KR, 350*e*KL and 350*f*KL (grooves 350*e*KL and 350*f*KL are not shown), respectively, the peripheral surface of the photosensitive drum 1 is in contact with the charge roller 2. Therefore, as the tray 350 is inserted into the main assembly of the image forming apparatus 100, the peripheral surface of the photosensitive drum 1 comes into contact with the outward surface of the electrostatic conveyance belt 213, readying the image forming apparatus 100 for an image forming operation. By the way, also in this embodiment, the movement of the tray 350 caused by the opening or closing of the front door 31 is similar to the movement of the tray 250 shown in FIGS. 8-10.

Even an image forming apparatus such as the image forming apparatus 100, shown in FIG. 14, which employs an ETB, can also be reduced in size by the employment of the LED unit 11 as an exposing apparatus. Further, this embodiment can provide an image forming apparatus which is excellent in usability in terms of the operation to insert a cartridge P into the cartridge tray of the apparatus, or extract a cartridge P from the cartridge tray. In terms of the structure of an image forming apparatus other than the above-described one, this embodiment is similar to the first embodiment. Further, the effects of this embodiment are similar to those of the first embodiment.

As described in the foregoing, the present invention can eliminate the operation for making a light emitting unit retreat from the area through which a cartridge is inserted into, or retracted from, the cartridge tray, when a cartridge is inserted into, or extracted from, the cartridge tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-093519 filed on May 10, 2017, which is hereby incorporated by reference herein in its entirety.

What is claimed is:

1. An image forming apparatus comprising:

a main assembly; and a cartridge including at least an image bearing member;

a tray drawable from said main assembly, wherein said cartridge is mountable to and dismountable from said tray in one direction and an opposite direction, respectively; and a light emission unit provided in said tray and including a plurality of light emission elements arranged in an axial direction of said image bearing member to form a latent image on said image bearing member, wherein said cartridge is capable of being inserted into said tray by moving said cartridge in the one direction, in response to which said light emission unit is moved in a direction crossing with the one direction to outside of a movement range of insertion of said cartridge.

2. An apparatus according to claim 1, further comprising an urging member configured to urge said light emission unit toward said cartridge, wherein when said cartridge is inserted into said tray, said cartridge is inserted to a predetermined position against an urging force of said urging member while a part of said cartridge is in contact with a part of said light emission unit, and said cartridge is placed at the predetermined position by the urging force of said urging member.

3. An apparatus according to claim 2, wherein said tray includes an engaging portion engageable with said light emission unit, and said light emission unit is positioned by the urging force of said urging member and said engaging portion.

4. An apparatus according to claim 1, wherein said tray includes an engaging portion engageable with said light emission unit, and said light emission unit is positioned by said engaging portion.

5. An apparatus according to claim 2, wherein the part of said cartridge is a surface of said image bearing member, and the part of said light emission unit is a rotatable member rotatably supported by said light emission unit.

6. An apparatus according to claim 1, wherein said cartridge includes a developer accommodating portion accommodating a developer, and said developer accommodating portion is disposed at a level higher than that of said image bearing member.

7. An apparatus according to claim 1, further comprising a charging device configured to charge said image bearing member.

8. An apparatus according to claim 1, further comprising an intermediary transfer member provided opposed to said image bearing member at a predetermined position in said main assembly.

9. An apparatus according to claim 8, wherein said intermediary transfer member is provided below said cartridge.

10. An apparatus according to claim 1, further comprising a feeding belt configured to feed a recording material and provided opposed to said image bearing member at a predetermined position.

11. An apparatus according to claim 10, wherein said feeding belt is provided below said cartridge.

* * * * *